US012509814B2

(12) United States Patent
Lee et al.

(10) Patent No.: US 12,509,814 B2
(45) Date of Patent: Dec. 30, 2025

(54) CLOTHING TREATMENT APPARATUS

(71) Applicant: LG Electronics Inc., Seoul (KR)

(72) Inventors: Donghwan Lee, Seoul (KR); Hoil Jeon, Seoul (KR); Kyungah Lee, Seoul (KR); Jaeyoung Kim, Seoul (KR); Kihyuk Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 44 days.

(21) Appl. No.: 17/926,828

(22) PCT Filed: Nov. 20, 2020

(86) PCT No.: PCT/KR2020/016466
§ 371 (c)(1),
(2) Date: Nov. 21, 2022

(87) PCT Pub. No.: WO2021/235628
PCT Pub. Date: Nov. 25, 2021

(65) Prior Publication Data

US 2023/0287622 A1 Sep. 14, 2023

(30) Foreign Application Priority Data

May 21, 2020 (KR) ..... 30-2020-0022489
Sep. 10, 2020 (KR) ..... 30-2020-0043317
Nov. 20, 2020 (KR) ..... 10-2020-0156268

(51) Int. Cl.
*D06F 73/02* (2006.01)
*D06F 58/12* (2006.01)
(Continued)

(52) U.S. Cl.
CPC ..... *D06F 73/02* (2013.01); *D06F 58/12* (2013.01); *D06F 58/203* (2013.01); *D06F 58/206* (2013.01); *D06F 58/24* (2013.01)

(58) Field of Classification Search
CPC ..... D06F 73/02; D06F 58/12; D06F 58/203; D06F 58/206; D06F 58/24; D06F 57/12;
(Continued)

(56) References Cited

U.S. PATENT DOCUMENTS 2,605,000 A * 7/1952 Tomarin ..... A47G 25/743 211/113
5,558,383 A * 9/1996 Lancellotti ..... A47G 25/1457 294/143
(Continued)

FOREIGN PATENT DOCUMENTS

CN 2397170 Y 9/2000
CN 1380459 A 11/2002
(Continued)

OTHER PUBLICATIONS

Office Action in Japanese Appln. No. 2022-571191, mailed on Nov. 7, 2023, 12 pages (with English translation).
(Continued)

*Primary Examiner* — Nathan E Durham
(74) *Attorney, Agent, or Firm* — Fish & Richardson P.C.

(57) ABSTRACT

The present disclosure provides a clothing treatment apparatus comprising: a cabinet having an injection hole in one surface thereof; a door rotatably coupled to the cabinet to open/close the injection hole; a first chamber which is located in the cabinet and receives clothing through the injection hole; a first tank which is located in the lower part of the first chamber and stores water; a second tank which is located on one side surface of the first tank in the lower part of the first chamber, and stores condensate water generated in the first chamber; and a hanger unit which is located in the first chamber to hold the clothing. The hanger unit includes: a hanger body assembly unit provided in the width direction of the first chamber; extended body units extending toward the bottom surface of the first chamber
(Continued)

between opposite ends of the hanger body assembly unit; and a clothing holding unit which is located at the side surface of each of the extended body units and holds the clothing.

20 Claims, 8 Drawing Sheets

(51) Int. Cl.
*D06F 58/20* (2006.01)
*D06F 58/24* (2006.01)

(58) Field of Classification Search
CPC ... D06F 57/00; A47G 25/145; A47G 25/1457; A47G 25/1464; A47G 25/1471; A47G 25/32
USPC ..... 211/113, 94.03, 85.3
See application file for complete search history.

(56) References Cited

U.S. PATENT DOCUMENTS

| | | | | |
|---|---|---|---|---|
| 6,053,377 | A * | 4/2000 | Beverly | A47G 25/28 223/92 |
| 7,137,515 | B1 | 11/2006 | Lawson et al. | |
| 8,141,722 | B2 * | 3/2012 | Heroux | A47G 25/1457 211/116 |
| 2009/0083990 | A1 * | 4/2009 | Bae | D06F 58/46 34/486 |
| 2010/0146805 | A1 * | 6/2010 | Kim | F26B 11/12 34/201 |
| 2011/0030147 | A1 * | 2/2011 | Yoo | D06F 58/44 8/137 |
| 2015/0152587 | A1 * | 6/2015 | Park | D06F 58/50 34/60 |
| 2017/0342651 | A1 | 11/2017 | Choi et al. | |
| 2018/0223470 | A1 * | 8/2018 | Yoon | D06F 87/00 |

FOREIGN PATENT DOCUMENTS

| | | | |
|---|---|---|---|
| CN | 102301061 | A | 12/2011 |
| CN | 108457060 | A | 8/2018 |
| JP | 2016-13362 | | 1/2016 |
| KR | 10-2013-0026835 | | 3/2013 |
| KR | 10-2014-0108455 | | 9/2014 |
| KR | 10-1595725 | | 2/2016 |
| KR | 10-2016-0028799 | | 3/2016 |
| KR | 10-2017-0010877 | A | 2/2017 |
| KR | 10-1989103 | | 6/2019 |
| KR | 10-2019-0127638 | | 11/2019 |
| KR | 10-2019-0131271 | A | 11/2019 |
| WO | WO 2020/027555 | | 2/2020 |

OTHER PUBLICATIONS

International Search Report and Written Opinion in International Appln. No. PCT/KR2020/016466, mailed Mar. 22, 2021, 17 pages (with English Translation).
Extended European Search Report in European Appln. No. 20936569.1, mailed on Jun. 19, 2024, 6 pages.
Office Action in Chinese Appln. No. 202080102756.0, mailed on Mar. 28, 2025, 22 pages (with English translation).
Office Action in Korean Appln. No. 10-2020-0156268, mailed on Jun. 13, 2025, 9 pages (with English translation).

* cited by examiner

PRIOR ART

CLOTHING TREATMENT APPARATUS

CROSS-REFERENCE TO RELATED APPLICATIONS

This application is a National Stage application under 35 U.S.C. § 371 of International Application No. PCT/KR2020/016466, filed on Nov. 20, 2020, which claims the benefit of Korean Application Nos. 10-2020-0156268, filed on Nov. 20, 2020, 30-2020-0043317, filed on Sep. 10, 2020, and 30-2020-0022489, filed on May 21, 2020. The disclosures of the prior applications are incorporated by reference in their entirety.

TECHNICAL FIELD

The present disclosure relates to a laundry treating apparatus. More specifically, the present disclosure relates to a hanger bar for hanging laundry.

BACKGROUND

A laundry treating apparatus refers to an apparatus developed for washing and drying laundry at home and in a laundry, and for removing wrinkles on the laundry. What is classified as the laundry treating apparatus includes a washing machine that washes the laundry, a dryer that dries the laundry, a washing machine/dryer that has both a washing function and a drying function, a clothes care apparatus that refreshes the laundry, a steamer that removes the wrinkles from the laundry, and the like.

The steamer is an apparatus that supplies steam to the laundry to remove wrinkles from the laundry. Unlike a regular iron, the steamer is an apparatus that removes the wrinkles by applying heat to the laundry via convection rather than directly heating the laundry (e.g., in a scheme of allowing the laundry to be in contact with a hard object).

On the other hand, the clothes care apparatus is an apparatus that allows the laundry to be maintained pleasant and clean. The clothes care apparatus may shake off fine dust attached to the laundry, deodorize the laundry, dry the laundry, and add aroma to the laundry. In addition, generation of static electricity may be prevented, the wrinkles on the laundry may be removed using dehumidified air or steam, and the laundry may be sterilized.

In particular, in order to further improve a fine dust removal performance, a wrinkle removal performance, and a laundry drying performance, the clothes care apparatus may include a hanger bar, a so-called moving hanger, capable of shaking the laundry after hanging the laundry thereon. That is, the hanger bar on which the laundry is hung may reciprocate in a certain direction.

Korean Patent No. 10-1285890 discloses a hanger assembly or a hanger bar in a form of a bar capable of reciprocating in a left and right direction using a rotational force of driving means. The hanger assembly has a shape in which a groove in which a clothes hanger may be hung is defined in a bar long in the left and right direction. In this case, there is a problem that a user has to pass the clothes hanger over the hanger assembly to hang the clothes hanger in the groove of the hanger bar. Therefore, because a user's view is temporarily obstructed by the hanger bar, it is difficult to accurately hang a central portion of a hook of the clothes hanger.

In addition, despite the fact that a space for accommodating the laundry, in particular, a vertical dimension of the accommodation space, is limited, the hanger bar has a problem that a space for connecting the hanger bar and driving means to each other, that is, a space between a top surface and a hanger bar is not able to be utilized entirely.

In addition, there is a problem in that the apparatus is not able to be used for a purpose of simply accommodating the laundry because the number of grooves of the hanger bar is not able to be further increased because a distance between two clothes must be widened for drying and steam.

SUMMARY

Technical Problem

First, the present disclosure is to improve utilization of a space between a hanger bar and driving means.

Second, the present disclosure is to improve user convenience when hanging a clothes hangers on a hanger bar.

Thirdly, the present disclosure is to provide more grooves for hanging clothes hangers, so that a hanging spacing between two clothes may be changed based on a user's choice.

Fourthly, the present disclosure is to conveniently hang laundry regardless of whether a user is left-handed or right-handed.

Technical Solutions

In order to solve the above-mentioned problems, the present disclosure is to provide a laundry treating apparatus including a hanger assembly whose shape is changed to more conveniently hang clothes and to hang more clothes. That is, unlike a conventional laundry treating apparatus including a hanger assembly in a simple straight shape and supports coupled to both ends of the hanger assembly to support the hanger assembly, the laundry treating apparatus according to the present disclosure has the same positions where the hanger assembly is coupled to the supports, but has a hanging portion extending downwards from the hanger assembly to hang laundry instead of a hanger groove for hanging the laundry defined in the hanger assembly.

To this end, provided is a laundry treating apparatus including a cabinet having an inlet defined in one surface thereof, a door pivotably coupled to the cabinet to open and close the inlet, a first chamber located inside the cabinet and accommodating laundry therein via the inlet, a first tank located below the first chamber and storing water therein, a second tank located below the first chamber and located on a side of the first tank and storing condensate generated in the first chamber therein, and a hanger assembly located inside the first chamber for hanging the laundry thereon, wherein the hanger assembly includes a hanger body assembly formed in a width direction of the first chamber, an extended body assembly extending toward a bottom surface of the first chamber at a location between both ends of the hanger body assembly, and a laundry hanging portion located at a side surface of the extended body assembly to hang the laundry thereon.

The hanger body assembly may include a central body including an opening defined therein so as to be opened in a direction toward a top surface of the first chamber, and a first body and a second body extending from the central body in a width direction of the first chamber, wherein the first body and the second body extend in opposite directions, the extended body assembly may include a first extended body extending from the central body toward the bottom surface of the first chamber by a predetermined first length, and a plurality of second extended bodies extending from the first body and the second body toward the bottom surface of the first chamber by a predetermined second length, and the laundry hanging portion may include a first hanging portion coupled to one of left and right side surfaces of the first extended body and having a notch shape in a depth direction of the first chamber to hang the laundry therein, and each of a plurality of second hanging portions coupled to one of left and right side surfaces of each of the plurality of second extended bodies and having a notch shape in the depth direction of the first chamber to hang the laundry therein.

The first hanging portion may include a first hanging body coupled to one of left and right side surfaces of a free end of the first extended body, a first hanging body top surface facing the top surface of the first chamber among surfaces of the first hanging body, and a first hanger groove defined by extending through the first hanging body including a portion of the first hanging body top surface in the depth direction of the first chamber, and each of the plurality of second hanging portions may include a second hanging body coupled to one of left and right side surfaces of a free end of each of the second extended bodies corresponding to each of the plurality of second hanging portions, a second hanging body top surface facing the top surface of the first chamber among surfaces of the second hanging body, and a second hanger groove defined by extending through the second hanging body including a portion of the second hanging body top surface in the depth direction of the first chamber.

The laundry hanging portion may further include a third hanging portion coupled to the other of the left and right side surfaces of the first extended body and having a notch shape in the depth direction of the first chamber to hang the laundry therein, and the third hanging portion may include a third hanging body coupled to the other of the left and right side surfaces of the free end of the first extended body, a third hanging body top surface facing the top surface of the first chamber among surfaces of the third hanging body, and a third hanger groove defined by extending through the third hanging body in the depth direction of the first chamber such that a portion of the third hanging body top surface is opened.

The first hanging portion and the third hanging portion may be located at the same vertical level relative to the bottom surface of the first chamber.

A maximum vertical dimension from the bottom surface of the first chamber to the first hanging body top surface may be smaller than a vertical dimension from the bottom surface of the first chamber to a position where the central body and the first extended body meet each other, and a maximum vertical dimension from the bottom surface of the first chamber to a top surface of one of the plurality of second hanging bodies may be smaller than a vertical dimension from the bottom surface of the first chamber to a position where the first body or the second body is coupled to the one second extended body and meets the corresponding one second extended body.

A vertical level of the first hanging body may be lower than a vertical level of the second hanging body based on the bottom surface of the first chamber.

The first body and the second body may be located closer to the opening than to a lower portion of the central body.

The first body may include a first hanger body coupled to the central body and extending toward a left side surface of the first chamber, and a first connection body extending from a free end of the first hanger body toward the bottom surface of the first chamber, and the second body may include a second hanger body coupled to the central body and extending toward a right side surface of the first chamber, and a second connection body extending from a free end of the second hanger body toward the bottom surface of the first chamber.

In addition, the laundry treating apparatus may further include a first support and a second support for supporting the hanger assembly, wherein the first support and the second support have one ends connected to the top surface of the first chamber and the other ends respectively connected to lower portions of the first connection body and the second connection body.

The laundry treating apparatus may further include a top panel for forming a top surface of the first chamber, and driving means located between the top panel and the top surface of the first chamber and generating a rotational force to reciprocate the hanger assembly in the width direction of the first chamber, and the driving means may include a first support and a second support extending through the top surface of the first chamber and respectively connected to the first connection body and the second connection body to support the hanger assembly.

A lower portion of the first support may be coupled to a lower portion of the first connection body, and a lower portion of the second support may be coupled to a lower portion of the second connection body.

The driving means may include power conversion means for reciprocating the hanger assembly by converting the rotational force of the driving means, the hanger assembly may further include a slot located inside the central body and defined in the depth direction of the first chamber, and the power conversion means may include a rotating protrusion rotating by the rotational force of the driving means, a connecting rod extending in an orthogonal direction from the rotating protrusion, and a connecting protrusion protruding from one end of the connecting rod and inserted into the slot to reciprocate the hanger bar.

In one example, the central body may be hemispherical.

The first hanging body top surface, the second hanging body top surface, and the third hanging body top surface may be curved surfaces.

In addition, the laundry hanging portion may further include each of a plurality of fourth hanging portions coupled to the other of left and right side surfaces of each of the plurality of second extended bodies and having a notch shape in the depth direction of the first chamber to hang the laundry therein, and each of the plurality of fourth hanging portions may include a fourth hanging body coupled to the other of the left and right side surfaces of the free end of each of the plurality of second extended bodies, a fourth hanging body top surface of surfaces of the fourth hanging body facing the top surface of the first chamber, and a fourth hanger groove defined by extending through the fourth hanging body in the depth direction of the first chamber such that a portion of the fourth hanging body top surface is opened.

In one example, provided is a laundry treating apparatus including a cabinet having an inlet defined in one surface thereof, a first chamber located inside the cabinet and accommodating laundry therein via the inlet, a second chamber positioned below the first chamber so as to define a space separated from the first chamber, a steam unit located inside the second chamber to supply steam to the first chamber, a blower unit located inside the second chamber to circulate air in the first chamber, a heat pump unit for exchanging heat with air sucked via the blower unit, a first tank located below the first chamber and in front of the second chamber, a second tank located below the first chamber and located on a side of the first tank and storing condensate generated in the first chamber therein, and a hanger assembly located inside the first chamber for hanging the laundry thereon, wherein the hanger assembly includes a hanger body assembly formed in a width direction of the first chamber, an extended body assembly extending toward a bottom surface of the first chamber at a location between both ends of the hanger body assembly, and a laundry hanging portion located at a side surface of the extended body assembly to hang the laundry thereon.

Advantageous Effects

First, the present disclosure may improve the utilization of the space between the hanger bar and the driving means.

Second, the present disclosure may improve the user convenience when hanging the clothes hangers on the hanger bar.

Thirdly, the present disclosure may provide the more grooves for hanging the clothes hangers, so that the hanging spacing between the two clothes may be changed based on the user's choice.

Fourthly, the present disclosure may allow the laundry to be conveniently hung regardless of whether the user is left-handed or right-handed.

DETAILED DESCRIPTION

Figure 1:
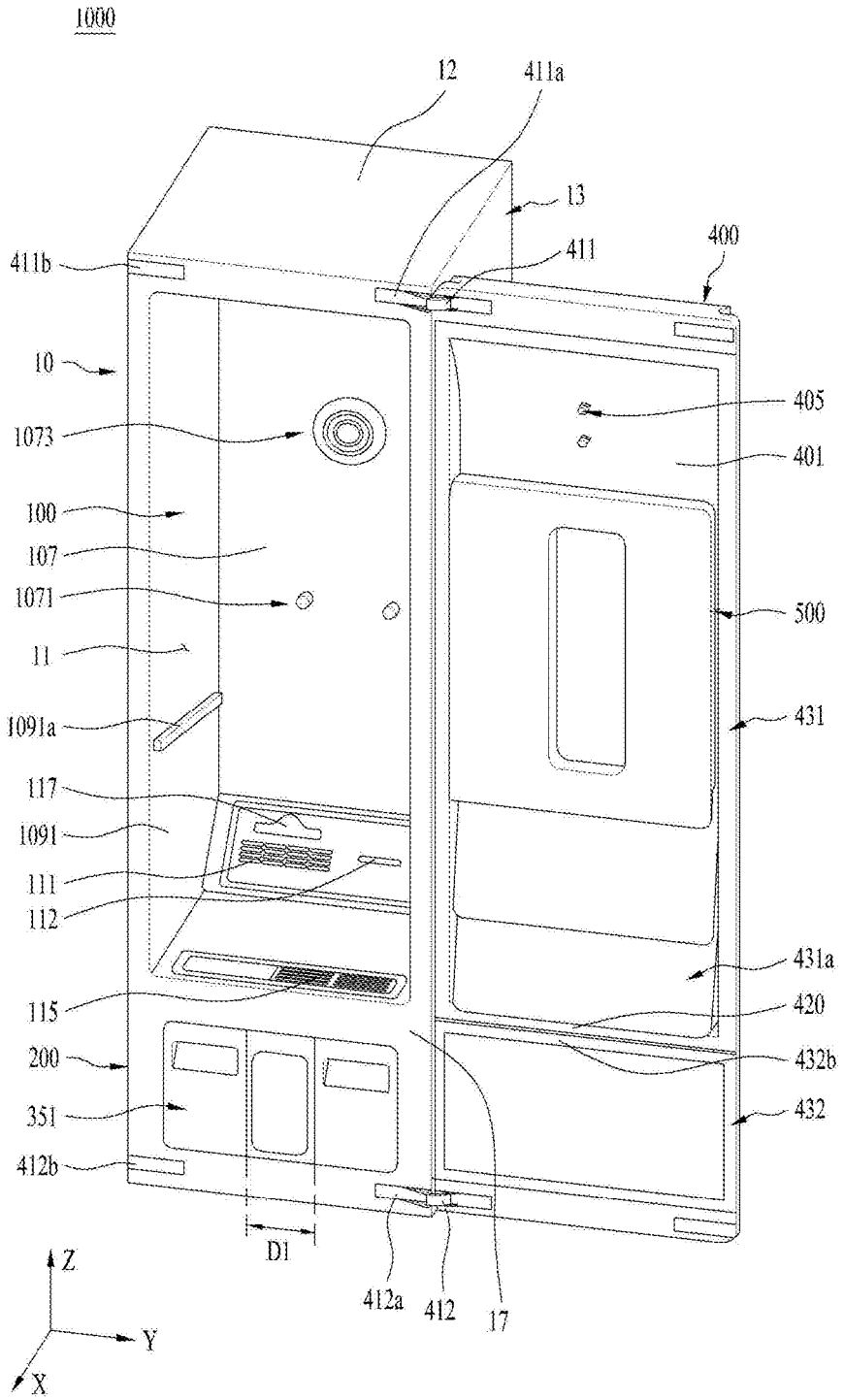
FIG. 1 is an example of a laundry treating apparatus.

Hereinafter, a preferred embodiment of the present disclosure will be described in detail with reference to the accompanying drawings. A configuration of a device or a method for controlling the same to be described below is only for describing an embodiment of the present disclosure, not for limiting the scope of the present disclosure, and reference numerals used the same herein refer to the same components.

Specific terms used herein are only for convenience of description and are not used as a limitation of the illustrated embodiment.

For example, expressions indicating that things are in the same state, such as "same", "equal", "homogeneous", and the like, not only indicate strictly the same state, but also indicate a state in which a tolerance or a difference in a degree to which the same function is obtained exists.

For example, expressions indicating a relative or absolute arrangement such as "in a certain direction", "along a certain direction", "parallel", "orthogonal", "central", "concentric", "coaxial", or the like not only strictly indicate such arrangement, but also indicate a state in which a relative displacement is achieved with a tolerance, or an angle or a distance that achieves the same function.

In order to describe the present disclosure, the description below will be achieved on the basis of a spatial orthogonal coordinate system with an X-axis, a Y-axis, and a Z-axis orthogonal to each other. Each axial direction (an X-axis direction, a Y-axis direction, or a Z-axis direction) means both directions in which each axis extends. Adding a '+' sign in front of each axial direction (a +X-axis direction, a +Y-axis direction, or a +Z-axis direction) means a positive direction, which is one of the two directions in which each axis extends. Adding a '−' sign in front of each axial direction (a −X-axis direction, a −Y-axis direction, or a −Z-axis direction) means a negative direction, which is the other of the two directions in which each axis extends.

Expressions referring to directions such as "front (+Y)/rear (−Y)/left (+X)/right (−X)/up (+Z)/down (−Z)" to be mentioned below are defined based on a XYZ coordinate axis. However, this is to describe the present disclosure such that the present disclosure may be clearly understood. In one example, each direction may be defined differently depending on the standard.

The use of terms such as 'first, second, third' in front of the components to be mentioned below is only to avoid confusion of the components referred to, and is independent of the order, importance, or master-slave relationship between the components. For example, an invention including only the second component without the first component may also be implemented.

Figure 2:
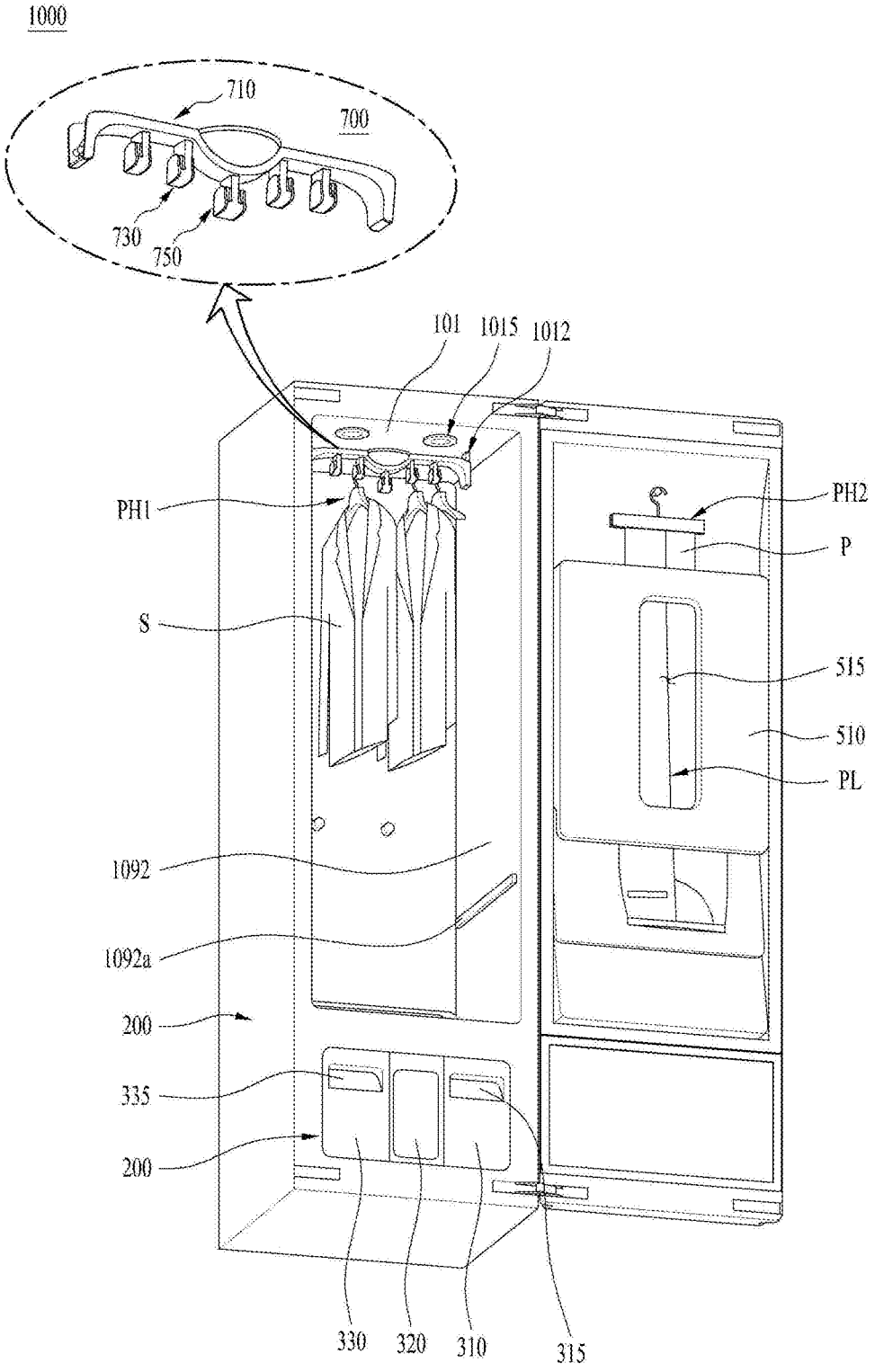
FIG. 2 shows an example of use of a laundry treating apparatus and an enlarged example of a hanger assembly.

FIGS. 1 and 2 show an example of a laundry treating apparatus 1000. Referring to FIGS. 1 and 2, the laundry treating apparatus 1000 according to the present disclosure may include a cabinet 10 having an inlet 11 defined in one surface thereof, a door 400 pivotably coupled to the cabinet 10 to open and close the inlet 11, a first chamber 100 located inside the cabinet and accommodating laundry therein via the inlet 11, a first tank 310 located below the first chamber 100, a second tank 330 located below the first chamber 100 and on one side of the first tank 310 and storing condensate generated in the first chamber 100 therein, and a hanger assembly 700 located inside the first chamber 100 and for hanging the laundry.

In addition, the hanger assembly 700 may include a hanger body assembly 710 formed in a width direction of the cabinet 10, an extended body assembly 730 extending toward a bottom surface 102 of the first chamber at a location between both ends of the hanger body assembly 710, and a laundry hanging portion 750 located at one side surface of the extended body assembly 730 and for hanging the laundry.

Referring to FIG. 1, the cabinet 10 may form an outer appearance of the laundry treating apparatus 1000 together with the door 400. A top panel 12 for forming a top surface of the cabinet 10 and side panels 13 for forming side surfaces of the cabinet 10 may be included, and the inlet 11 may be included in a front surface of the cabinet 10. The laundry may be accommodated in or withdrawn from the first chamber 100 located inside the cabinet 10 via the inlet 11.

A second chamber (not shown) may be located below the first chamber 100. The second chamber may accommodate various mechanical devices and controllers required for laundry management shown in FIGS. 3A and 3B therein. Because the second chamber is located below the first chamber 100 and at the rear of the first tank 310 and the second tank 330 to be described later, the second chamber will not be exposed even when the door 400 is opened.

The first chamber 100 may be formed by a top surface 101 of the first chamber located inside the cabinet 10 and forming a ceiling of the first chamber 100, a bottom surface 102 of the first chamber forming a bottom surface of the first chamber 100, a rear surface 107 of the first chamber forming a rear surface of the first chamber, and a left side surface 1091 of the first chamber and a right side surface 1092 of the first chamber forming side surfaces between the top surface 101 of the first chamber and the bottom surface 102 of the first chamber. A front surface of the first chamber 100 may be in communication with the inlet 11. The bottom surface 102 of the first chamber and the rear surface 107 of the first chamber may be connected to each other at an angle.

Sterilization and deodorization means 1073 capable of sterilizing and deodorizing air inside the first chamber may be located on the rear surface 107 of the first chamber. The sterilization and deodorization means 1073 may include an ultraviolet lamp. That is, the air may be sterilized by an ultraviolet ray and odor particles may be decomposed by a deodorant or the ultraviolet ray. The sterilization and deodorization means 1073 may irradiate the ultraviolet ray to the air sucked in by convection. In addition, the sterilization and deodorization means 1073 may further include a filter (not shown) for filtering fine dust.

Rear surface shelf hangers 1071 for hanging a shelf (not shown) usable for the first chamber 100 may be positioned on the rear surface 107 of the first chamber. The rear surface shelf hangers 1071 may be positioned below the sterilization and deodorization means 1073 by a predetermined distance.

A first shelf hanger 1091*a* and a second shelf hanger 1092*a* (see FIG. 2) constructed to support a shelf (not shown) may be positioned on both of the side surfaces 1091 and 1092 of the first chamber, respectively. The first shelf hanger 1091*a* and the second shelf hanger 1092*a* may have a bar shape formed in a depth direction (an X direction) of the first chamber. Otherwise, any structure capable of supporting the shelf may be used.

A first port 111 and a third port 112 for supplying steam generated by a steam unit 250 and air dehumidified and heated by a heat pump unit 230 in the second chamber to the first chamber 100, and a second port 115 for sucking the air from the first chamber 100 again using a blower unit 220 may be located at the rear of the bottom surface 102 of the first chamber, specifically, in an inclined portion where the bottom surface 102 of the first chamber and the rear surface 107 of the first chamber are connected to each other. In addition, aromatizing means 117 capable of installing a fragrance or a fragrance sheet that may add fragrance to the air discharged from the first port 111 may be positioned. Referring to FIG. 1, the aromatizing means 117 may be located above the first port 111, but may be located anywhere as long as the air supplied to the first chamber 100 may be aromatized.

The second port 115 may also be used to discharge condensate obtained as the steam is condensed from the first chamber 100. That is, the condensate generated on an inner circumferential surface of the first chamber 100 will flow or fall to the bottom surface 102 of the first chamber due to its own weight. The bottom surface 102 of the first chamber forms an inclined surface toward the second port 115, so that the condensate will naturally flow toward the second port 115. The condensate discharged via the second port 115 will eventually flow down an air supply duct 221 (see FIGS. 3A and 3B) and will be temporarily stored in a sump (not shown) located in an inner lower portion of the air supply duct.

Likewise, the condensate generated on a door inner surface 401, which will be described later, will fall to the bottom surface 102 of the first chamber along a door liner 420 disposed on the door inner surface and be discharged to the sump (not shown) via the second port 115. The condensate collected in the sump as such will be discharged to the second tank 330 via a drain pump 339 (see FIGS. 3A and 3B) and collected in the second tank 330.

The second port 115 may be located on the bottom surface 102 of the first chamber so as to be close to the inlet 11. Accordingly, a circulation structure in which the air inside the first chamber 100 is discharged via the first port 111 and sucked in via the second port 115 may be formed. When the steam is discharged via the third port 112 and condensed into the condensate, the condensate will be sucked via the second port 115 and then be collected in the sump (not shown) for storing the condensate.

The bottom surface 102 of the first chamber may be inclined downwards from the rear surface of the first chamber 100 in a direction of the second port 115 in order to more smoothly discharge the condensate condensed inside the first chamber 100 to the second chamber via the second port 115.

The door 400 pivotably coupled to the cabinet 10 so as to open and close the inlet 11 may include a laundry hook assembly 405 positioned on the door inner surface facing the inlet and for hanging the laundry. Further, the laundry hook assembly 405 may be in a form of a ring or a hook that may hang a clothes hanger or a pants hanger. Referring to FIG. 1, the laundry hook assembly 405 may include a plurality of clothes hanger hooks so as to hang pants at different places based on a size of the pants for using pressing means to be described later. The plurality of clothes hanger hooks may be arranged at a regular spacing along a height direction of the door.

The door 400 may include the door inner surface 401 located on a rear surface of the door 400 or at a side of the door 400 facing the first chamber 100 when the door 400 is closed. The door 400 will be pivotably connected to the cabinet 10 in a hinged manner so as to open and close the inlet 11. To this end, the door 400 may include door hinges 411 and 412 for pivotable coupling.

In addition, door hinge coupling portions 411*a*, 411*b*, 412*a*, and 412*b* may be positioned on the cabinet so as to be coupled to a left side of the door or a right side of the door. Therefore, depending on whether a user is left-handed or right-handed, a direction in which the door opens may be changed by changing only positions of the door hinges 411 and 412. FIG. 1 shows that the door is opened in a counterclockwise direction when viewed from above when the user is right-handed. Otherwise, in order to open the door in a clockwise direction, only the door hinges 411 and 412 may be coupled to the opposite side of the door 400 and then coupled to the door hinge coupling portions 411*b* and 412*b* located on a left side of the front surface of the cabinet. Such a door is called a reversible door.

The door 400 may further include sealing means 430 for preventing the steam supplied to the first chamber 100 by the steam unit 250 (see FIGS. 3A and 3B) from escaping, and the door liner 420 disposed on the door inner surface 401 and guiding the condensate generated on the door inner surface 401 to be discharged via the second port 115.

In general, water boils at 100° C. under atmospheric pressure. water vapor generated at this time may be referred to as steam. In contrast, moisture refers to a form in which water droplets with a size equal to or smaller than 1 mm are suspended in the air at room temperature. For example, the moisture is similar to fog. In general, the steam generated by heating and boiling water has excellent sterilizing power because of a high temperature compared to the moisture, and has excellent laundry permeability because water molecules move more actively at a higher temperature, so that the steam may be used more than the moisture to refresh the laundry.

When the door 400 is closed, the sealing means 430 may seal a space between the door 400 and the cabinet 10 to prevent leakage of the steam or the condensate to the outside. The sealing means 430 may be in a form of covering edges of the door inner surface 401. The sealing means 430 may also perform a function of mitigating an impact between the cabinet 10 and the door 400 when the door is closed.

The sealing means 430 may include a first gasket 431 having a size corresponding to a front surface of the first chamber 100 of a portion of the door inner surface 401, and a second gasket 432 having a size corresponding to a front surface of a portion below the first chamber 100, that is, a space where the first tank 310 and the second tank 330 are located.

The first gasket 431 will seal the first chamber to prevent the condensate generated in the first chamber 100 and on the door inner surface 401 from flowing toward the first tank 310 or the second tank 330.

A lower gasket 431*a* of the first gasket 431 formed in a width direction of the door 400 to seal a lower portion of the first chamber 100 and an upper gasket 432*b* of the second gasket 432 formed in the width direction of the door to seal an upper portion of a tank installation space 351 may be in contact with a front contact portion 17 located between the first chamber 100 and the tank installation space 351 and facing the door inner surface 401.

The door liner 420 may be coupled to the door inner surface 401 to serve as a guide such that the condensate generated on the door inner surface 401 flows to the second port 115. That is, the door liner 420 may be formed in a shape protruding and inclined in a downward direction of the door inner surface 401. A lower end of the door liner 420 may protrude from the door inner surface 401 such that the lower end of the door liner 420 is positioned above the second port 115. Accordingly, the condensate flowing downwards along the door liner 420 may be discharged directly to the second port 115 by falling from the lower end of the door liner 420.

Alternatively, the condensate falling from the door liner 420 toward the bottom surface 102 of the first chamber may be guided by a separate guide member disposed on the bottom surface 102 of the first chamber and discharged to the second port 115.

Referring to FIG. 2, the top surface 101 of the first chamber may include lighting means 1015 for illuminating the first chamber. FIG. 2 shows that the lighting means 1015 includes a plurality of lamps, but the lighting means 1015 may include a single lamp.

In addition, the laundry treating apparatus 1000 may include the hanger assembly 700 disposed inside the first chamber 100 to hang the laundry.

Referring to an enlarged picture of the hanger assembly 700 in FIG. 2, the hanger assembly 700 may include the hanger body assembly 710 formed in the width direction of the cabinet 10, the extended body assembly 730 extending toward the bottom surface 102 of the first chamber at the location between both ends of the hanger body assembly 710, and the laundry hanging portion 750 positioned on one side surface of the extended body assembly 730 to hang the laundry.

The laundry hook assembly 405 may be used to hang the laundry disposed on the door inner surface 401 to remove wrinkles therefrom and put a crease therein, and the hanger assembly 700 may be used to remove the wrinkles and refresh the laundry using a reciprocating motion of the hanger assembly 700.

Figure 4B:
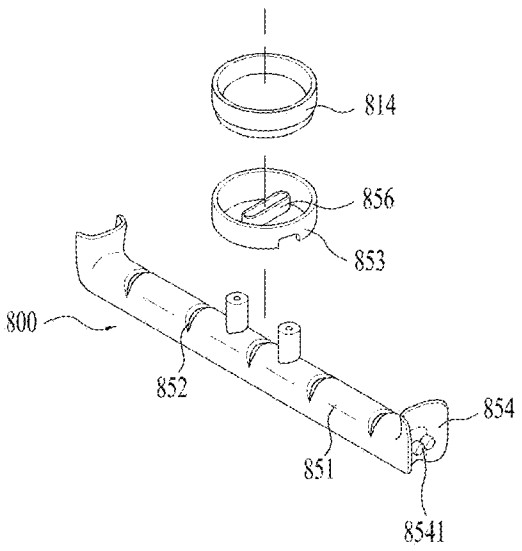
FIG. 4B shows a conventional hanger assembly.
Figure 4A:
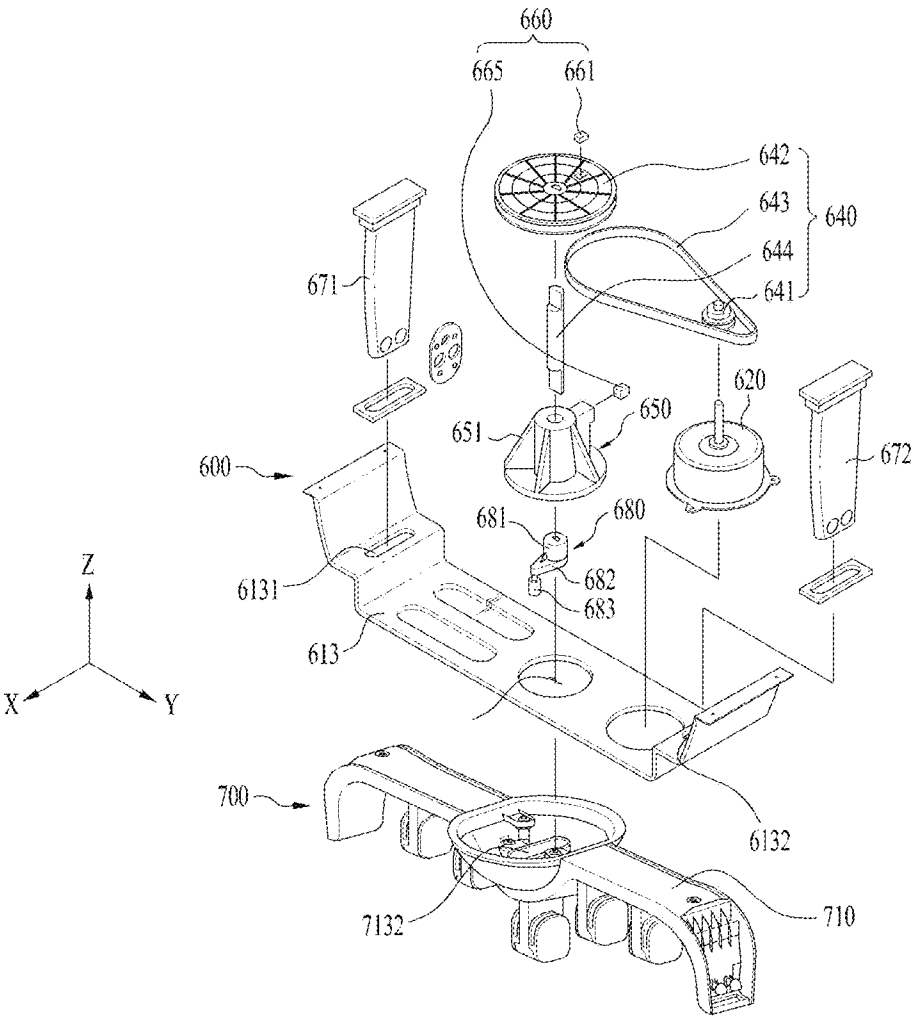
FIG. 4A is an exploded view of a hanger assembly and driving means.
Figure 5:
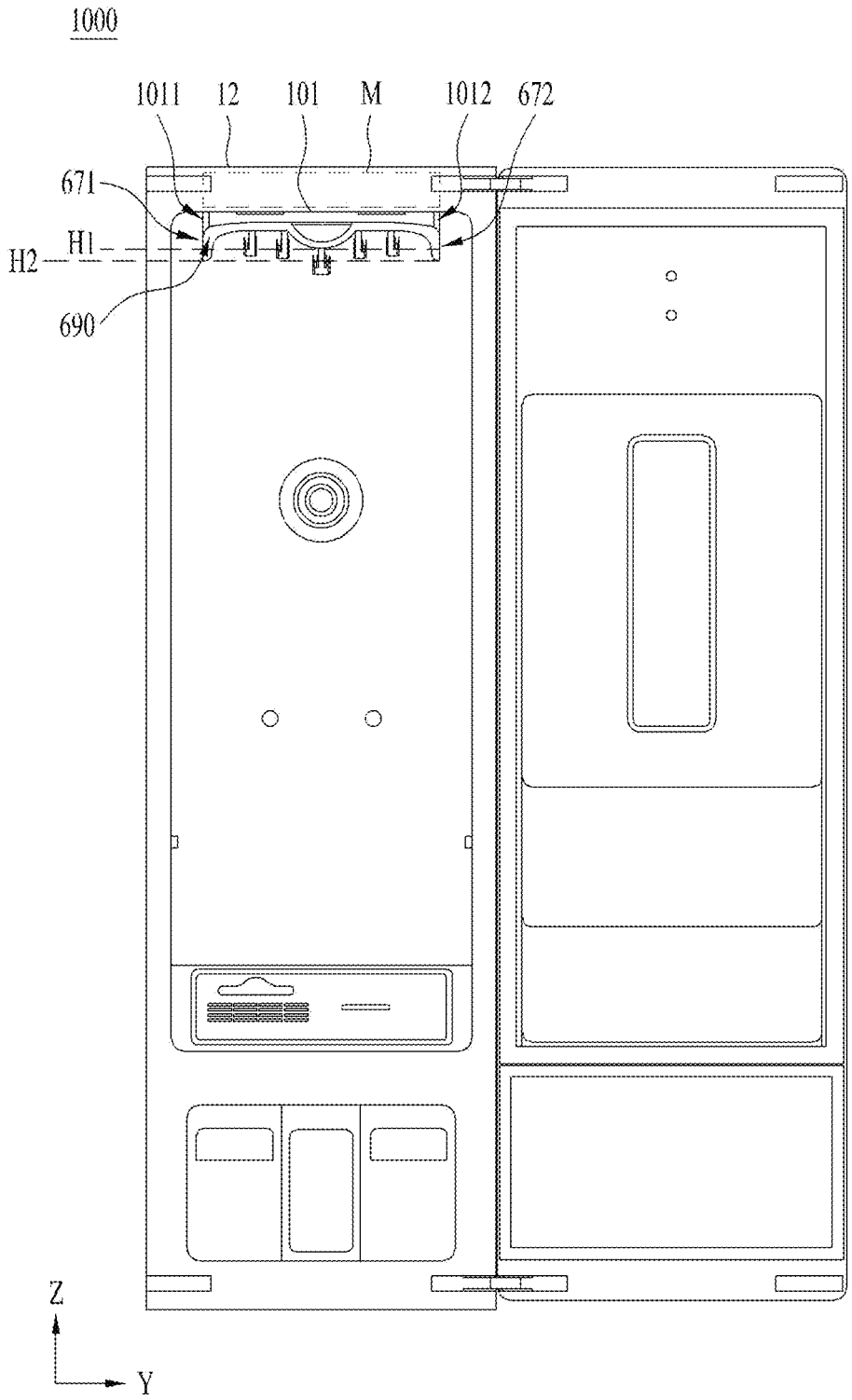
FIG. 5 is a front view of a laundry treating apparatus in FIG. 1 or 2.

Driving means 600 for transmitting power such that the hanger assembly 700 may reciprocate in a predetermined movement direction, and a support frame 613 that supports the driving means 600 may be included (see FIGS. 4A and 5).

A length of the hanger body assembly 710 along the width direction of the first chamber may be smaller than a width of the first chamber 100. This is to prevent the hanger assembly 700 from colliding with both side surfaces 1091 and 1002 of the first chamber when reciprocating along the width direction of the first chamber.

Referring to FIG. 2, on the door inner surface 401 or inside the first chamber 100, the laundry hook assembly 405 for hanging a pants hanger PH2 after placing bottoms (or pants P) on the pants hanger PH2, and the pressing means 500 for pressing the pants P fixed by the laundry hook assembly 405 may be positioned. On the other hand, in the hanger assembly 700, the laundry may be hung on the hanger assembly 700 using a clothes hanger PH1.

A reason for hanging the pants P upside down, that is, with a bottom hem up, is to spread the pants P evenly to some extent by a self-weight of the pants P because a waist portion of the pants P, that is, a pant waist of the pants P is heavier than the bottom hem of the pants P, that is, pant legs.

The pressing means 500 may include a base plate (not shown) coupled to the door inner surface 401 to support the laundry, and a pressing plate 510 for pressing the pants P by pivoting toward the base plate (not shown). When the pressing plate 510 pivots toward the base plate 520, the pants P may be pressed.

To this end, for the pivoting of the pressing plate 510, the pressing means 500 may further include a pressing means hinge (not shown) for hinged coupling of the pressure plate 510 and the base plate, and a pressing plate fixing portion (not shown) for coupling and fixing the pressing plate 510 and the base plate to each other.

When the door 400 is closed and the pants P is exposed to the steam and hot air after placing the pants P between the pressure plate 510 and the base plate, wrinkles of the pants P may be removed and sharp wrinkles, so-called sharp creases, may be formed in the waist portion of the pants P.

To this end, because it is necessary for the steam to easily permeate the pants P, a steam penetration hole 515 extending through the pressure plate 510 may be included. In addition, in order to prevent a seam PL disposed along a longitudinal direction of the waist portion from being pressed, a first recessed portion (not shown) and a second recessed portion (not shown) may be further included above and below the steam penetration hole 515 in one of both surfaces of the pressure plate 510 in contact with the pants P.

In one example, the base plate (not shown) may be made of an elastic material so as to support the pressurized laundry, or may further include an elastic member for elastically supporting the base plate on the door.

As shown in FIG. 1 or 2, in the laundry treating apparatus 1000, the first tank 310 for supplying water to the steam unit 250 and the second tank 330 for storing the condensate discharged from the first chamber 100 may be disposed below the first chamber 100 and at the front portion of the second chamber (not shown). In addition, a tank module frame (not shown) for defining the tank installation space 351 in which the first tank 310 and the second tank 330 are installed may be disposed so as to separate the tank installation space 351 and the second chamber from each other. That is, the tank installation space 351 and the second chamber (not shown) may be located beneath the first chamber 100, and the tank installation space 351 may be located closer to the door 400 than the second chamber. Therefore, the second chamber may be located at the rear of the tank installation space 351.

In addition, referring to FIGS. 1 and 2, it is shown that a storage 320 is disposed between the first tank 310 and the second tank 330. That is, the second tank 330 may be disposed at a distance equal to or greater than a predetermined distance D1 from one side surface of the first tank 310. However, unlike this, one side surface of the first tank 310 may face one side surface of the second tank 330 without any other components.

The storage 320 may store consumables such as cleaning tools or the fragrance sheets. The storage 320 may be constructed to be opened when the user presses a front surface of the storage 320 and closed when the user presses the front surface again.

Each of the first tank 310 and the second tank 330 may be detachable from the tank module frame (not shown). Alternatively, the first tank 310 and the second tank 330 may be combined into one and detached at the same time.

When the user closes the door 400, a front surface of the first tank 310 and a front surface of the second tank 330 may face the door inner surface 401, and when the user opens the door 400, the front surface of the first tank 310 and the front surface of the second tank 330 may be exposed to the outside.

The front surfaces of the first tank 310 and the second tank 330 may be made of a light-transmitting material, which is transparent or translucent, so as to immediately check water levels of the first tank 310 and the second tank 330 when the door 400 is opened. Otherwise, the first tank 310 and the second tank 330 may include a first tank window (not shown) and a second tank window (not shown) for checking the water level on a portion of the front surfaces thereof to check the levels of water stored in the first tank 310 and the second tank 330, respectively.

The front surface of the first tank 310 and the front surface of the second tank 330 may include a first tank handle 315 and a second tank handle 335, respectively. When the user pulls the first tank handle 315 and the second tank handle 335, the first tank 310 and the second tank 330 may be removed from the tank module frame (not shown) by pivoting around a front surface distal end of the first tank and a front surface distal end of the second tank, respectively. In addition, when the first tank 310 and the second tank 330 are mounted on the tank module frame (not shown), the first tank 310 and the second tank 330 will be mounted on the tank module frame (not shown) via the pivoting in the same way.

The laundry treating apparatus 1000 according to the present disclosure may include the hanger assembly 700 located inside the first chamber 100 and for hanging the laundry, and the driving means 600 (see FIGS. 4A and 5) for generating a rotational force to reciprocate the hanger assembly 700 in the width direction of the cabinet 10. That is, the hanger assembly 700 may vibrate in the width direction of the cabinet 10 to shake the laundry hung on the hanger assembly 700. Accordingly, dust or fine dust attached to the laundry may be removed, the laundry may be sterilized and deodorized using the steam, and the wrinkles may be removed using the steam and the reciprocating motion of hanger assembly. This may be referred to as laundry management, and the hanger assembly 700 reciprocating in the width direction of the cabinet 10 as such is referred to as a moving hanger.

Herein, the wrinkles refer to fine lines formed unintentionally after wearing clothes or after washing or drying the laundry. In other words, the wrinkles refer to a form in which fabric is unintentionally wrinkled due to the use, the washing, or the drying, rather than intentional wrinkles (pleat or crease) formed for aesthetics or function from a design stage.

Referring to FIG. 5, the driving means 600 may be located between the top panel 12 and the top surface 101 of the first chamber. This is to avoid exposing the driving means 600 to the user for aesthetics of the first chamber 100. The driving means 600 may include a first support 671 and a second support 672 respectively connected to both ends of the hanger assembly 700. The hanger assembly 700 may be supported via the first support 671 and the second support 672. Further, when the hanger assembly 700 reciprocates in the width direction of the cabinet 10, the first support 671 and the second support 672 may also pivot along the movement direction of the hanger assembly 700.

The first support 671 and the second support 672 may connect the driving means 600 and the hanger assembly 700 to each other respectively via a first upper communication hole 1011 and a second upper communication hole 1012 extending through the top surface 101 of the first chamber.

In one example, the cabinet 10 may be made of a metal material, and may be made of a plastic material as long as it may maintain strength thereof. In addition, the first chamber 100 may be formed by plastic injection molding. The first chamber 100 may be coupled to the cabinet 10 by a frame (not shown), but a space between the cabinet 10 and the first chamber 100 or between the cabinet 10 and the second chamber 200 may be filled with foamed plastic such as polyurethane.

Figure 3B:
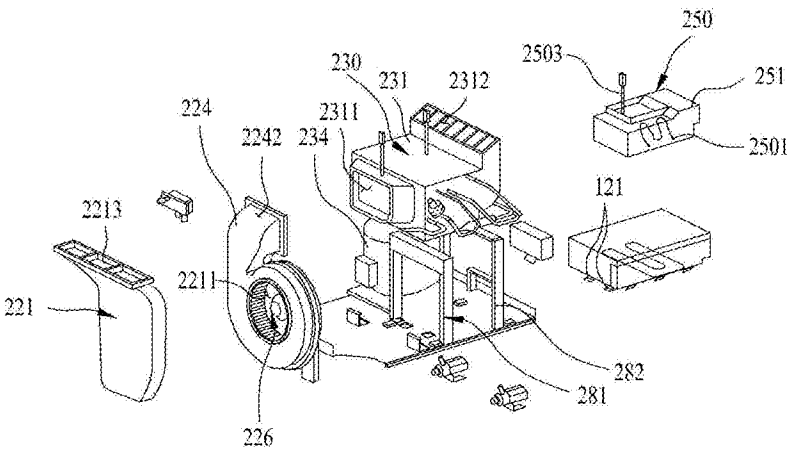
FIG. 3B is an exploded view of the blower unit, the heat pump unit, and the steam unit.
Figure 3A:
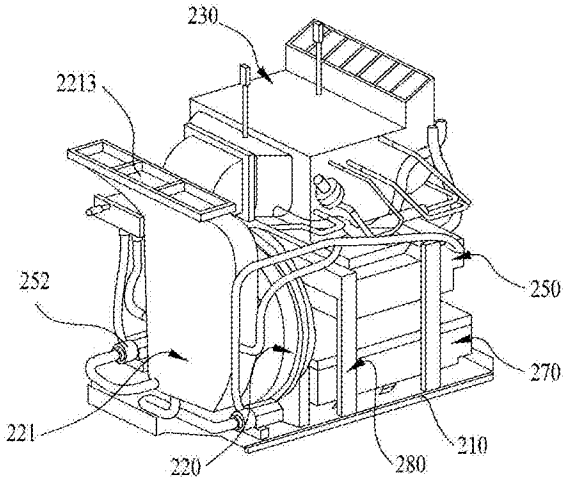
FIG. 3A shows a blower unit, a heat pump unit, and a steam unit disposed inside a second chamber.

FIGS. 3A and 3B show several mechanical devices accommodated inside the second chamber 200. As described above, the second chamber 200 is located below the first chamber 100 and at the rear of the tank installation space 351. The mechanical devices may include devices that allow the laundry treating apparatus 1000 to function as the clothes care apparatus. This is for a purpose of the clothes care apparatus of smoothing the wrinkles of the laundry, deodorizing the laundry, and sterilizing the laundry.

Referring to FIG. 3A, the blower unit 220 for sucking the air from the first chamber 100, the steam unit 250 for receiving the water from the first tank 310 to generate the steam and then supplying the steam to the first chamber 100, and the heat pump unit 230 for dehumidifying and heating the air sucked by the blower unit 220 and then discharging the air to the first chamber 100 may be included inside the second chamber 200. The steam unit 250, the blower unit 220, and the heat pump unit 230 may be installed on the base 210.

A supporter assembly 280 for supporting the steam unit 250 and the heat pump unit 230 may be coupled to the base 210. The supporter assembly 280 may include a first supporter 281 located closer to the blower unit 220 and a second supporter 282 located farther from the blower unit 220.

The heat pump unit 230 may be located on the supporter assembly 280, and the steam unit 250 may be located inside the supporter assembly 280, that is, in an accommodating area S defined between the supporter assembly 280 and the base 210. In addition, a controller 270 for controlling the blower unit 220, the steam unit 250, and the heat pump unit 230 may be located in the accommodating area S.

However, this is merely an example, and the controller 270 may be located at the rear of the second chamber 200. When the controller 270 is located at the rear of the second chamber 200, the controller 270 may be attached and detached via a rear panel (not shown) that is in communication with the second chamber 200 and is located on the rear surface of the cabinet.

The controller 270 may also control the pressing means 500 to be described later. In addition, the controller 270 may control a reciprocating motion of the driving means 600 (see FIGS. 3A and 3B).

The steam unit 250 may be constructed to sterilize, deodorize, and remove wrinkles from the laundry hung in the first chamber 100, and the blower unit 220 and the heat pump unit 230 may be constructed to circulate the air in the first chamber 100 and dehumidify the air via a heat exchange.

Referring to FIG. 3B, the blower unit 220 may include a blowing fan 226 and the air supply duct 221. When a side on which the inlet 11 is located is referred to as a front side and a side on which a rear surface of the first chamber is located is referred to as a rear side, the air supply duct 221 may be disposed in front of the blowing fan 226 and the tank module frame may be disposed in front of the air supply duct 221. Accordingly, the tank module frame may define the tank installation space 351 and separate the tank installation space 351 from the second chamber 200.

Each of the first tank 310 and the second tank 330 seated on the tank module frame may be located close to one of both side surfaces of the cabinet 10. For example, the first tank 310 may be located in the tank installation space 351 closer to a right side surface of the cabinet 10 than to a left side surface of the cabinet. Conversely, the second tank 330 may be located closer to the left side surface of the cabinet 10 than to the right side surface of the cabinet 10.

Similarly to the location of the first tank 310, the steam unit 250 may also be located inside the second chamber 200 closer to the right side surface of the cabinet 10 than to the left side surface of the cabinet 10. This is to place the steam unit 250 at the rear of the first tank 310 to simplify a connection passage through which water flows from the first tank 310 to the steam unit 250.

The steam unit 250 may include a storage 251 for storing water and a heater 2501 located inside the storage 251 to heat water. In addition, the steam unit 250 may further include a steam temperature sensor 9131 for measuring a temperature of the water stored in the storage 251.

The water located in the storage 251 may be heated via the heater 2501. The steam generated via the heating may be supplied to the first chamber 100 via a third port 112 disposed on the bottom surface 102 of the first chamber along a steam passage (not shown).

The water used in the steam unit 250 may be supplied via the first tank 310. When the first tank 310 is seated in the tank installation space 351, a water supply check valve (not shown) disposed on the bottom surface of the first tank 310 will be opened, and the water will be supplied to the storage 251 via a water supply passage connected to the water supply check valve.

When the first tank 310 is located closer to the left side surface of the cabinet 10 than to the right side surface of the cabinet 10, the steam unit 250 may also be located closer to the left side surface of the cabinet 10 than to the right side surface of the cabinet 10 correspondingly. This is to reduce a length of the water supply passage (not shown) for connecting the first tank 310 and the steam unit 250 to each other and simplify the water supply passage as much as possible.

The blower unit 220 may suck air via the second port 115 located on the bottom surface 102 of the first chamber and the air supply duct 221 to circulate the air in the first chamber 100. The air supply duct 221 may include an air supply duct inlet 2213 formed in a shape corresponding to the second port 115, an air supply duct body 2211 for flowing the sucked air to the blowing fan 226, and an air supply duct outlet 2215 connected to an inlet of the blowing fan 226.

The blowing fan 226, as a type of centrifugal blower, may discharge the sucked air using a centrifugal force. The blowing fan 226 may be connected to the heat pump unit 230 via a blower housing 224. Therefore, the air sucked via the blowing fan 226 will flow to an air inlet 2311 of a duct housing 231 connected to a blower outlet 2242 of the blower housing 224.

The heat pump unit 230 may include the duct housing 231, which is a passage through which the air flows, the air inlet 2311 located at one end of the duct housing 231 and sucking the air from the blowing fan 226, and an air outlet 2312 located at the other end of the duct housing 231 and discharging the air to the first chamber 100.

The heat pump unit 230 may further include a first heat exchanger (not shown) and a second heat exchanger (not shown) positioned inside the duct housing 231 to exchange heat with the sucked air. In addition, the heat pump unit 230 may further include a compressor 234 positioned outside the duct housing 231 to compress and circulate a refrigerant and supply the refrigerant to the first heat exchanger and the second heat exchanger.

The compressor 234 may be located on a side of the supporter assembly 280. Because the first tank 310 is located close to one side surface of the cabinet 10, and the steam unit 250 and the supporter assembly 280 are also located inside the second chamber 200 close to one side surface of the cabinet 10, the compressor 235 may be located close to one side surface of the cabinet 10, which is the other side surface of the cabinet 10. For example, referring to FIG. 3B, the compressor 235 is located biased to the right side (that is, closer to the right side surface than to the left side surface of the cabinet), and the supporter assembly 280 and the steam unit 250 are located biased to the left side (closer to the left side surface than to the right side surface of the cabinet).

In addition, the air supply duct 221 may include the air supply duct inlet 2213 that is in communication with the second port 115 disposed on the bottom surface 102 of the first chamber to suck the air from the first chamber 100. In addition, the air supply duct inlet 2213 may form an inclined passage. This is to allow the condensate generated in the first chamber 100 and on the door 400 to easily flow to the sump (not shown) located in the inner lower portion of the air supply duct 221 along the inclined passage after passing through the air supply duct inlet 2213 in communication with the bottom surface 102 of the first chamber.

The air supply duct 221 may be located in front of the blowing fan 226, and the steam unit 250 and the heat pump unit 230 may be disposed at the rear of the blowing fan 226. In addition, the heat pump unit 230 may be supported by the supporter assembly 280. The supporter assembly 280 may be coupled to the base 210 forming the bottom surface of the second chamber 200. Accordingly, the supporter assembly 280 may define a predetermined spaced distance between the base 210 and the heat pump unit 230, and may define the predetermined accommodating area S between the supporter assembly 280 and the base 210.

The steam unit 250 may be located in the accommodating area S, and may be coupled to the supporter assembly 280 in the accommodating area S. In addition, the steam unit 250 may be spaced apart from the base 210 and coupled to the supporter assembly 280.

Unlike as shown in FIG. 3B, the blower unit 220 may be disposed inside the duct housing 231 to circulate the air in the first chamber 100. Alternatively, the blower unit 220 may be installed between the air outlet 2312 and the second heat exchanger (or a condenser). The air discharged via the air outlet 2312 will flow into the first chamber 100 via the first port 111 in communication with the air outlet 2312.

In the duct housing 231, the condensate may be generated via heat exchange between the first heat exchanger (or an evaporator) and the sucked air. The condensate generated in the heat pump unit 230 may be discharged to the second tank 330 by flowing to the sump (not shown) via the bottom surface of the duct housing 231.

The air and/or the steam supplied by the heat pump unit 230 and the steam unit 250 may be applied to the laundry accommodated in the first chamber 100 to affect physical or chemical properties of the laundry. For example, a texture structure of the laundry may be relaxed by the hot air or the steam to smooth the wrinkles, and odor molecules in the laundry may react with the steam to remove an unpleasant odor. In addition, the hot air and/or the steam supplied by the heat pump unit 230 and the steam unit 250 may sterilize microorganisms such as bacteria, fungi, and viruses parasitic on the laundry.

FIGS. 4A and 4B show the driving means 600 and the hanger assembly 700 of the laundry treating apparatus 1000 according to the present disclosure. The laundry treating apparatus 1000 may include the driving means 600 to reciprocate the hanger assembly 700 in the width direction of the cabinet 10 in order to shake the laundry hung on the hanger assembly 700. As shown in FIG. 5, the driving means 600 may be located in a space M defined between the top panel 12 and the top surface 101 of the first chamber. This is not only to prevent exposing the driving means 600 to the user for aesthetics, but also to prevent the driving means 600 from being exposed to moisture and a high temperature inside the first chamber 100.

The driving means 600 may include a motor 620 for generating the rotational force and power conversion means 680 for reciprocating the hanger assembly by converting the rotational force of the motor 620. In addition, the driving means 600 may include the first support 671 and the second support 672 supporting the hanger assembly. The first support 671 and the second support 672 may be positioned to face each other with the motor 620 interposed therebetween. The first support 671 and the second support 672 may be respectively connected to both ends of the hanger body assembly 710 to support the hanger body assembly 710 and move in the same direction during the movement of the hanger body assembly 710.

The driving means 600 may further include the support frame 613 for supporting the first support 671 and the second support 672 and supporting the motor 620.

The driving means 600 may be disposed in a space between the first chamber 100 and the cabinet 10 so as to be located above the first chamber 100. The driving means 600 may include the motor 620 for generating the rotational force. The driving means 600 may be seated on the support frame 613 fixed between the first chamber 100 and the cabinet 10. The support frame 613 may buffer vibration generated when the driving means 600 operates.

Because the driving means 600 is disposed above the first chamber 100, an internal space of the first chamber 100 may be sufficiently secured to treat a large amount of laundry. In addition, when the driving means 600 is disposed at a side, an overall length of the laundry treating apparatus 1000 in the width direction is increased. The laundry treating apparatus 1000 according to the present disclosure has an advantage of being implemented in a slim form as a whole because the driving means 600 is disposed above the first chamber 100. Because the laundry treating apparatus 1000 may be implemented slimly, it is easy to install the apparatus 1000 in a narrow space such as indoors. In addition, because the driving means 600 is installed using the space located outside and above the first chamber 100, the internal space of the first chamber 100 may be increased, thereby increasing an amount of laundry that may be treated. In addition, components that are weak to the moisture, such as the motor 620, may be prevented from being exposed to the first chamber 100 to which the steam is sprayed.

The driving means 600 may include power transmission means 640 that transmits the rotational force of the motor 620 to the power conversion means 680. The power transmission unit 640, which transmits a rotational motion of the motor to a rotational motion of the power conversion means 680, may be implemented in various forms by those skilled in the art of the present disclosure.

Referring to FIGS. 4A and 4B, the power transmission unit 640 may include a driving pulley 641 rotated by the motor 620, a driven pulley 642 connected to the driving pulley 641 by a belt 643 and rotating together with the driving pulley 641, and a rotating shaft 644 that is fastened to the driven pulley 642 and rotates.

A diameter of the driven pulley 642 is larger than that of the driving pulley 641. Because the driving pulley 641 receives the rotational force directly from the motor 620, the driving pulley 641 rotates at a relatively high speed. When the hanger assembly 700 reciprocates at the same cycle as a cycle of the rotational motion generated by the motor, excessive vibration and noise are generated and the motor 620 is overloaded, resulting in a decrease in an efficiency of treating the laundry hung on the hanger assembly 700. Therefore, by making the diameter of the driven pulley 642 larger than that of the driving pulley 641, the reciprocating cycle of the hanger assembly 700 may be appropriately adjusted. The driving pulley 641 and the driven pulley 642 preferably have a diameter ratio of 1:5 to 1:15.

In one example, the power transmission means 640 may be implemented in various ways, such as being composed of a driving gear, a driven gear, and a chain instead of the driving pulley 641, the driven pulley 642, and the belt 643 described above.

In addition, the laundry treating apparatus 1000 may further include a bearing assembly 650 extrapolated to the rotating shaft 644. The bearing assembly 650 may include a bearing housing 651 for forming an outer appearance of the bearing assembly 650, and a first bearing (not shown)

disposed between the rotating shaft 644 and an inner surface of the bearing housing 651. The bearing assembly 650 is fixed to the support frame 613 to support the rotating shaft 644 and to smoothly rotate the rotating shaft 644. Preferably, the first bearing may be an oilless bearing such that the laundry accommodated in the first chamber 100 is not contaminated.

The power conversion means 680 may reciprocate the hanger assembly 700 in the width direction of the first chamber 100 by converting the rotational motion transmitted from the power transmission means 640. The power conversion means 680 may include a rotating protrusion 681 connected to the rotating shaft 644 of the power transmission means 640, a connecting rod 682 extending from the rotating protrusion 681, and a connecting protrusion 683 protruding from one end of the connecting rod 682, rotating around the rotating shaft 644, and inserted into a slot 7132 defined in the hanger assembly 700.

The rotating protrusion 681 may be formed at one end of the power conversion means 680 and may include an insertion hole (not shown) into which the rotating shaft 644 is inserted. Preferably, the connecting rod 682 extends from the rotating protrusion 681 in a substantially perpendicular direction to the rotating shaft 644. The connecting protrusion 683 may extend downwards from one end of the connecting rod 682.

When the rotating shaft 644 rotates, the connecting protrusion 683 will rotate with a predetermined radius from the rotating shaft 644. When the connecting rod 682 is formed in a direction orthogonal to the rotating shaft 644, the predetermined radius will be a length of the connecting rod 682.

When the connecting rod 682 rotates, the connecting protrusion 683 will eventually rotate. The connecting protrusion 683 may be inserted into the slot 7132. Specifically, the slot 7132 may further include a slot rib 7132*a* defining a slot inner space 7133, and the connecting protrusion 683 will be located in the slot inner space 7133.

The slot 7132 is preferably defined long in a direction orthogonal to the movement direction of the hanger assembly 700. That is, when the hanger assembly 700 reciprocates in the width direction (the Y/−Y direction) of the first chamber 100, the slot 7132 will be defined in the depth direction (the X/−X direction) of the first chamber 100.

When the hanger assembly 700 and the driving means 600 are viewed from above, the force transmitted to the hanger assembly 700 by the connecting protrusion 683 when the connecting protrusion 683 rotates may always be resolved into a force in the width direction (the Y/−Y direction) of the first chamber 100 and a force in the depth direction (the X/−X direction) of the first chamber 100. When a length of the slot 7132 in the depth direction is greater than a rotation diameter of the connecting rod 682 during the rotation of the connecting rod 682, the force will be transmitted to the hanger assembly 700 by the slot 7132 in the width direction (the Y/−Y direction) of the first chamber 100, but the force will not be transmitted in the depth direction (the X/−X direction) of the first chamber 100. Even when the length of the slot 7132 in the depth direction is smaller than the rotation diameter of the connecting rod 682 during the rotation, most of the force will not be transmitted in the depth direction (the X/−X direction) of the first chamber 100 when the power conversion means 680 rotates.

Therefore, the hanger assembly 700 may reciprocate in the width direction (the Y/−Y direction) of the first chamber 100 because of the shape of the slot 7132.

Figure 6:
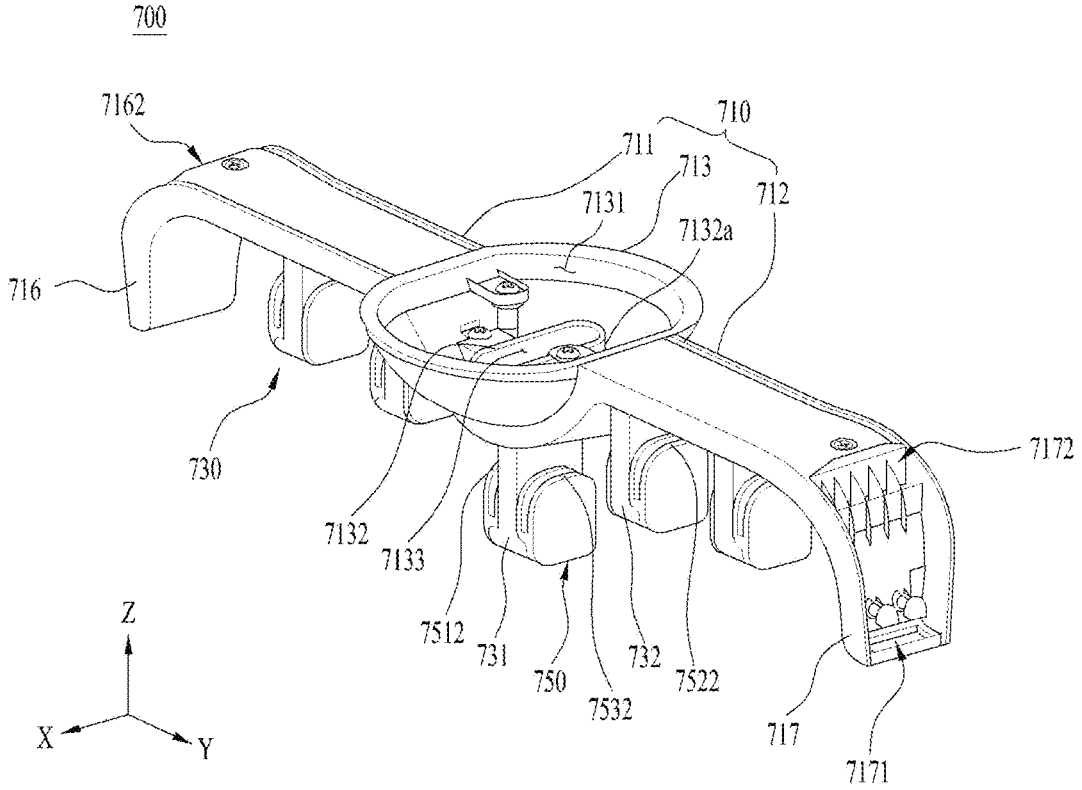
FIG. 6 shows a hanger assembly according to the present disclosure.

In one example, the moisture contained in the humid air in the first chamber 100 may be condensed and thus water may accumulate inside a central body 713 (see FIG. 6). Accordingly, the central body 713 may include a drain hole (not shown) such that the stagnant water may be drained to the outside of the central body 713.

The first support 671 and the second support 672 supported by the support frame 613 and connected to the hanger assembly 700 to support the hanger assembly 700 inside the first chamber 100 may contain an elastic member to allow the hanger assembly 700 to smoothly reciprocate. In particular, it is preferable that the first support 671 and the second support 672 are in a form of a plate long in the front and rear direction to limit reciprocation of the hanger assembly 700 along the depth direction (the X/−X direction) of the first chamber, and one ends thereof are coupled to the support frame 613 or the cabinet 10 and the other ends thereof are coupled to one side of the hanger assembly 700. That is, the first support 671 and the second support 672 may be coupled to both ends of the hanger assembly 700, specifically to both ends of the hanger body assembly 710.

The driving means 600 shown in FIG. 4A is one example. Alternatively, the driving means 600 may be implemented in a manner of reciprocating the hanger assembly 700 via a harmonic excitation motion using an eccentric mass.

Referring to FIG. 4A, the driving means 600 may further include sensing means 660 for identifying a position of the hanger assembly 700. The sensing means 660 may include a magnetic body 661 disposed in the driven pulley 642, and a magnetic force detection sensor 665 disposed in the bearing housing 651 for supporting the rotating shaft and connected to the controller 270 (see FIGS. 3A and 3B).

This is to return the hanger assembly 700 to an initial position, that is, to a position located at a center of the first chamber 100, when the operation of the laundry treating apparatus 1000 is completed. This is because, when the position of the hanger assembly 700 remains biased to one side of the first chamber 100, not only the first support and the second support 672 supporting the hanger assembly 700 may be overburdened, but also aesthetics impression of the user who opens the door 400 may be deteriorated. To prevent such problem, the driving means 600 may further include the sensing means 660 for identifying the position of the hanger assembly 700.

In the above-described embodiment, the case in which the magnetic body 661 is disposed in the driven pulley 642 and the magnetic force sensor 665 is disposed in the bearing housing has been described, but the positions of the magnetic body 661 and the magnetic force sensor 665 may be variously changed as long as the magnetic force sensor 665 is able to sense a magnetic force of the magnetic body 661.

The support frame 613 may include a first support receiving hole 6131 and a second support receiving hole 6132 defined through the support frame 613 to correspond to the length of the hanger body assembly 710. The first support 671 and the second support 672 may be respectively inserted into the first support receiving hole 6131 and the second support receiving hole 6132 and be coupled to the support frame 613. In addition, a conversion means receiving hole 6133 may be positioned at a center of the support frame 613 into which the power conversion means 680 is inserted to be connected to the slot 7132.

FIG. 4A shows an example of the hanger assembly 700, which is a feature of the present disclosure, and FIG. 4B shows an example of a conventional hanger assembly 800. Referring to FIG. 4B, the conventional hanger assembly 800 may include a hanger body assembly 851 in a form of a straight bar. In addition, the conventional hanger assembly 800 may include a connection body 854 formed by being bent toward the top surface 101 of the first chamber at each of both ends of the hanger body assembly 851. In addition, fastening portions 7161 and 7171 respectively coupled to the first support 671 and the second support 672 may be disposed at both ends of the hanger body assembly 851, that is, points at which the connection bodies 854 meet the hanger body assembly 851.

In addition, the hanger body assembly 851 may have a hanger groove 852 defined therein in a form of a notch into which the clothes hanger is hung. An outer surface of the hanger groove 852 may be made of an elastic material similar to rubber, so that the user is able to hang and remove the clothes hanger into and from the hanger groove 852 when applying a certain force.

Operating mechanism of the conventional hanger assembly 800 and the driving means 600 may be the same. That is, the power conversion means 680 may be inserted into a slot 856 to reciprocate the hanger body assembly 851 in a left and right direction.

However, in order to hang the clothes hanger on the hanger body assembly 851, the user should hang the clothes hanger in the hanger groove 852 by passing a hook of the clothes hanger over the hanger body assembly 851. Considering a position of the hanger body assembly 851, generally, the user will have to extend a hand thereof upwards, then pass the hook of the clothes hanger over the hanger body assembly 851, then locate the hanger groove 852, and then hang the hook of the clothes hanger. Therefore, because a view of the user is obstructed by the hanger body assembly 851, it may not be easy to identify whether a portion of the hook of the clothes hanger to be hung in the hanger groove is properly positioned on the hanger groove 852. Such inconvenience is caused by the fact that the hook of the clothes hanger has to pass over the hanger body assembly 851.

In addition, the conventional hanger body assembly 851 may be connected to the first support 671 and the second support 672 by fastening portions 8541 disposed at both ends of the hanger body assembly 851, respectively. This means that a height of the hanger body assembly 851 from the bottom surface 102 of the first chamber is determined by a length of the first support 671 and the second support 672. Therefore, there is a problem in that a space between a vertical level at which the first support 671 and the second support 672 meet the hanger body assembly 851 to accommodate the laundry and the top surface 101 of the first chamber is not able to be reduced.

In addition, there is a problem in that the number of plurality of hanger grooves 852 defined in the hanger body assembly 851 is not able to be further increased. This is because, when a size of the first chamber 100 is determined, a length of the hanger body assembly 851 is also determined, and a distance between the laundry must be secured to be a distance equal to or greater than a certain distance for the penetration of the steam and the supply of the hot air.

The present disclosure is intended to solve the several problems of the conventional hanger assembly 800. FIG. 4A shows the example of the hanger assembly 700 according to the present disclosure. Unlike the conventional hanger assembly 800, the hanger assembly 700 may include the hanger body assembly 710 formed in the width direction of the cabinet 10, the extended body assembly 730 extending toward the bottom surface 102 of the first chamber at the location between both ends of the hanger body assembly 710, and the laundry hanging portion 750 positioned on one side surface of the extended body assembly 730 for hanging the laundry.

In addition, the hanger assembly 700 may further include a first connection body 716 and a second connection body 717 respectively extending from both ends of the hanger body assembly 710 toward the bottom surface 102 of the first chamber. The first support 671 and the second support 672 may be respectively coupled to the first connection body 716 and the second connection body 717 to support the hanger assembly 700.

FIG. 5 shows a front view of the laundry treating apparatus 1000 with the door open. As described above, the driving means 600 may be located in the space M between the top panel 12 and the top surface 101 of the first chamber. This is not only for design, but also to prevent corrosion and failure caused by exposure of the driving means 600 to the first chamber 100 to which the steam and the hot air are supplied for the management of the laundry.

The driving means 600 may include the first support 671 and the second support 672 having one ends connected to the support frame 613 and the other ends connected to both ends of the hanger assembly 700 by extending through the top surface of the first chamber. To connect the driving means 600 to the first support and the second support 672, the top surface 101 of the first chamber may include a first upper communication hole 1011 and a second upper communication hole 1012 defined to extend therethrough. In addition, in order for the power conversion means 680 to be inserted into the slot, the top surface 101 of the first chamber may further include a power conversion means communication hole (not shown) defined therethrough. The power conversion means communication hole 1013 may be located in the top surface 101 of the first chamber so as to be connected to the slot 7132, in particular, corresponding to the location of the central body to be described later.

Accordingly, the power conversion means communication hole 1013 may be located between the first upper communication hole 1011 and the second upper communication hole 1012.

Referring to FIG. 5, the power conversion means 680 will be inserted into the slot 7132 located inside the central body 713, which will be described later, but may be mostly covered by the central body 713 when viewed from the front surface of the laundry treatment apparatus.

Dotted lines H1 and H2 indicated along the width direction of the hanger assembly show a position of the conventional hanger assembly 800. That is, when the conventional hanger assembly 800 shown in FIG. 4B is located beneath the same driving means 600, the hanger body assembly will be located between H1 and H2. Therefore, in the hanger assembly 700, except for a first hanger groove 7513 located in the central body, positions of a plurality of second hanger grooves 7523 located in the first body 711 and the second body 712 may be higher than positions of the hanger grooves 852 of the conventional hanger assembly 800 based on the bottom surface 102 of the first chamber.

This is because, in the case of the conventional hanger assembly 800, the connection bodies 854 respectively coupled to the first support 671 and the second support 672 are located at both ends of the hanger body assembly 851, and thus, the hanger body assembly 851 is eventually located downwardly of the top surface 101 of the first chamber by the length of the first support 671 and the second support 672.

In addition, this is because, on the other hand, in the case of the hanger assembly 700 described in the present disclosure, the hanger body assembly 710 is located relatively higher than the hanger body assembly 851 of the conventional hanger assembly 800, and the first support 671 and the first connection body 716 are coupled to each other and the second support 672 and the second connection body 717 are coupled to each other at free ends of the first connection body 716 and the second connection body 717 bent toward the bottom surface 102 of the first chamber. respectively. Therefore, this is because, even when the length of the first support 671 and the second support 672 are the same as before, because the hanger body assembly 710 is located relatively higher, a position of a hanger groove in which the laundry is actually hung may be higher than a position of a hanger groove of the conventional hanger assembly even when a second hanging portion 752 for hanging the laundry descends from the hanger body assembly 710 toward the bottom surface 102 of the first chamber by a second length.

This means that longer clothes is able to be accommodated compared to the case in which the conventional hanger assembly 800 is used in the first chamber 100 of the same size. In addition, this means that the space between the hanger assembly 700 and the top surface 101 of the first chamber may be used more efficiently in terms of accommodation of the laundry.

In addition, the hanger groove 852 of the conventional hanger body assembly 851 is simply dug into the hanger body assembly 851 in the notch form. Therefore, when the laundry is hung in the hanger groove 852, the hook of the clothes hanger must pass over the hanger body assembly 851. On the other hand, in the hanger assembly 800 of the present disclosure, even though the hanger body assembly 710 is located relatively higher than the conventional hanger body assembly 851, a first hanging portion 751 and the second hanging portion 752 for hanging the laundry may be located lower than the hanger body assembly 710 by the extended body assembly 730. In addition, because the clothes hanger may be hung on the laundry hanging portion 750 between a first extended body 731 and a plurality of second extended bodies 732 included in the extended body assembly 730, hassle of passing the clothes hanger over the hanger body assembly 710 may be reduced.

Referring to FIG. 6, the hanger assembly 700 may include the hanger body assembly 710 formed in the width direction of the cabinet 10, the extended body assembly 730 extending toward the bottom surface 102 of the first chamber between both ends of the hanger body assembly 710, and the laundry hanging portion 750 positioned on one side surface of the extended body assembly 730 to hang the laundry.

More specifically, the hanger body assembly 710 may include the central body 713 including an opening 7131 opened in a direction toward the top surface 101 of the first chamber, and a first body 711 and a second body 712 extending from the central body 713 in the width direction of the first chamber 100. The extended body assembly 730 may include the first extended body 731 extending from the central body 713 toward the bottom surface 102 of the first chamber by a predetermined first length, and the plurality of second extended bodies 732 extending from the first body 711 and the second body 712 toward the bottom surface 102 of the first chamber by a predetermined second length.

In addition, the laundry hanging portion 750 may include the first hanging portion 751 coupled to one of left and right side surfaces of the first extended body 731 and having a notch shape in the depth direction of the first chamber 100 to hang the laundry, and the plurality of second hanging portions 752 respectively coupled to one of left and right side surfaces of the plurality of second extended bodies 732 and having a notch shape in the depth direction of the first chamber 100.

That is, while the conventional hanger body assembly 851 has a shape of a bar with the hanger grooves dug therein, the hanger body assembly 710, which is the present disclosure, may include the central body 713, and the first body 711 and the second body located on both sides of the central body 713 so as to be closer to the opening 7131 than to a lower portion of the central body 713 and extending in the left and right directions.

The central body 713 may include the opening in one surface thereof facing the top surface 101 of the first chamber, and include the slot 7132 inside the central body 713. The central body 713 may have a hollow hemispherical shape. This is because the slot 7132 may be defined inside, and the connecting protrusion 683, which is a portion of the power conversion means 680, may be inserted into the slot inner space 7133. Because the slot 7132 is included inside the central body 713, most of the power conversion means 680 is covered by the central body 713, so that the central body 713 may also play a role of protecting the power conversion means 680.

The reason why the shape of the central body 713 is hemispherical is for the power conversion means 680 to secure a rotation space with a size equal to the rotation diameter of the connecting rod 682. Accordingly, a radius of the opening 7131 may be greater than the length of the connecting rod 682.

The extended body assembly 730 may include the first extended body 731 extending from the central body 713 toward the bottom surface 102 of the first chamber by the predetermined first length, and the plurality of second extended bodies 732 extending from the first body 711 and the second body 712 toward the bottom surface 102 of the first chamber by the predetermined second length.

The first length and the second length may be the same or different. In addition, the second lengths of the respective plurality of second extended bodies 732 may be different from each other.

Referring to FIG. 6, the plurality of second extended bodies 732 disposed on the first body 711 and the second body 712 may be symmetrically arranged with each other about the central body 713 and have a spacing therebetween. This is to prevent a weight of the hanger assembly 700 from being biased to one side. Accordingly, although FIG. 6 shows five extended bodies including the first extended body 731, this is merely an embodiment.

The hanger assembly 700 may include the first connection body 716 and the second connection body 717 formed by being bent from the first body 711 and the second body 712 toward the bottom surface 102 of the first chamber, respectively. In addition, the hanger assembly 700 may include a first reinforcing rib 7162 and a second reinforcing rib 7172 for reinforcing strength because stress may be concentrated at positions where the first body 711 and the second body 712 meet the first connection body 716 and the second connection body 717, respectively.

In addition, the hanger assembly 700 may include a first fastening portion 7161 and a second fastening portion 7171 for being coupled to the first support 671 and the second support 672 at lower portions of the first connection body 716 and the second connection body 717, respectively. The first fastening portion 7161 and the second fastening portion 7171 are respectively coupled to the first support 671 and the second support 672 in a hook coupling or screw coupling manner. The first support 671 and the second support 672 may include coupling grooves at corresponding positions when being coupled to the first fastening portion 7161 and the second fastening portion 7171, respectively.

This is to secure a distance that the hanger assembly 700 may move when reciprocating in the width direction of the first chamber, like in the conventional hanger assembly 800.

Figure 7A:
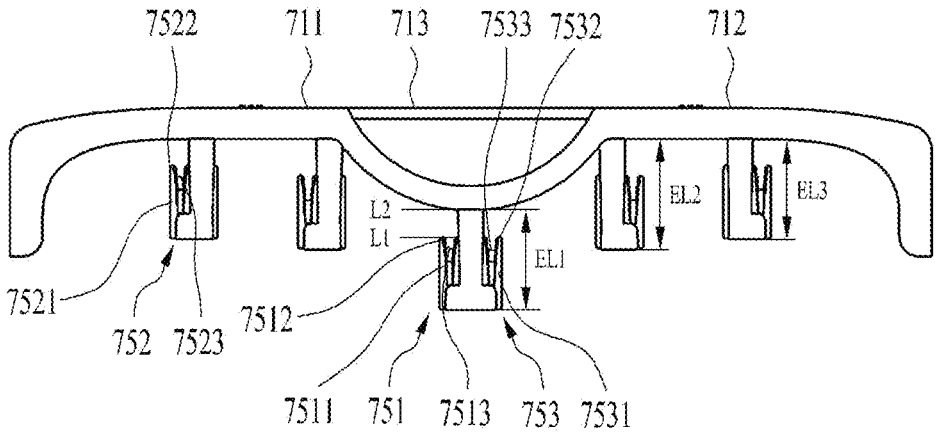
FIG. 7A is a front view of a hanger assembly.

Referring to FIG. 7A, the first hanging portion 751 may include a first hanging body 7511 coupled to one of left and right side surfaces of a free end of the first extended body 731, a first hanging body top surface 7512 of surfaces of the first hanging body 7511 facing the top surface 101 of the first chamber, and a first hanger groove 7513 defined by extending through the first hanging body 7511 including a portion of the first hanging body top surface 7512 in the depth direction (the X/−X direction) of the first chamber.

In addition, each of the plurality of second hanging portions 752 may include a second hanging body 7521 coupled to one of left and right side surfaces of a free end of each second extended body 732 corresponding to each of the plurality of second hanging portions 752, a second hanging body top surface 7522 of surfaces of the second hanging body facing the top surface 101 of the first chamber, and a second hanger groove 7523 defined by extending through the second hanging body 7521 including a portion of the second hanging body top surface 7522 in the depth direction (the X/−X direction) of the first chamber.

That is, in the hanging portions 751 and 752, notch-shaped hanger grooves may be defined in the depth direction (the X/−X direction) of the first chamber 100. This is to use the space efficiently by hanging the laundry accommodated in the space of the first chamber 100 in the depth direction (the X/−X direction) of the first chamber 100.

The hanging portions 751 and 752 are portions where a hook of a blouse hanger or a pants hanger is hung. The hanging portions 751 and 752 may be arranged in the width direction (the Y/−Y direction) of the first chamber 100 such that the hanger grooves thereof are visible in the depth direction (the X/−X direction) of the first chamber. It is preferable that the first extended body 731 and the plurality of second extended bodies 732 are spaced apart from each other by a predetermined distance such that the steam and the hot air may evenly permeate each clothes via a space between each two clothes. This is because, when a gap between the first extended body 731 and the second extended body 732 or between the plurality of second extended bodies 732 is narrow, it is difficult for the steam and the hot air to permeate the laundry, so that the sterilization function, the wrinkle removal function, and the drying function may be deteriorated.

The laundry hanging portion may further include a third hanging portion coupled to the other of the left and right side surfaces of the first extended body 731 and having a notch shape in the depth direction (the X/−X direction) of the first chamber 100 to hang the laundry.

The third hanging portion 753 may include a third hanging body 7531 coupled to the other of the left and right side surfaces of the free end of the first extended body 731, a third hanging body top surface 7532 of surfaces of the third hanging body 7531 facing the top surface 101 of the first chamber, and a third hanger groove 7533 defined by extending through the third hanging body 7531 in the depth direction of the first chamber such that a portion of the third hanging body top surface 7532 is opened.

This is because, in a case of a thin clothes such as a dress shirt, the steam and the hot air may be sufficiently supplied to the clothes even when a distance between the two clothes is not great.

In one example, at least one surface for defining each of the hanger grooves 7513, 7523, and 7533 may be an inner inclined surface of each of the hanging bodies 7511, 7521, and 7531. That is, the hanger groove may be defined in the notch shape (e.g., a V-shaped notch) in each hanging body, and at least one of notch surfaces may be formed as the inclined surface. Therefore, when the user hangs the hook of the clothes hanger in each of the first hanger groove 7513, the second hanger groove 7523, and the third hanger groove 7533, the hook may be naturally seated in each of hanger grooves 7513, 7523, and 7533 along the inclined surface of each of the hanger grooves 7513, 7523, and 7533.

Accordingly, entrances of the hanger grooves 7513, 7523, and 7533 may be wide, and may the hanger grooves 7513, 7523, and 7533 may become narrower inwardly. To this end, when the hanger groove has the notch shape, the at least one surface for defining the hanger groove may be inclined.

Otherwise, one side surface of the first hanging body where the first hanging body 7511 meets the first extended body 731 may be longer than the other side surface of the first hanging body located on a side opposite to the one side surface of the first hanging body. Accordingly, the top surface 7512 of the first hanging body may be inclined from one side surface of the first hanging body toward the other side surface of the first hanging body. Alternatively, a portion of the top surface 7512 of the first hanging body located at a portion of the first hanging body around the first hanger groove 7513 that meets the first extended body 731 may be inclined toward the first hanger groove 7513. This is to naturally guide the clothes hanger toward the first hanger groove 7513 via the inclined top surface when the user hangs the clothes hanger (see FIG. 8).

The inclined top surface of the hanging body may also be applied to other laundry hanging portions, that is, the second hanging body 7512, the third hanging body 7513, and a fourth hanging body (not shown) in the same manner.

Figure 7B:
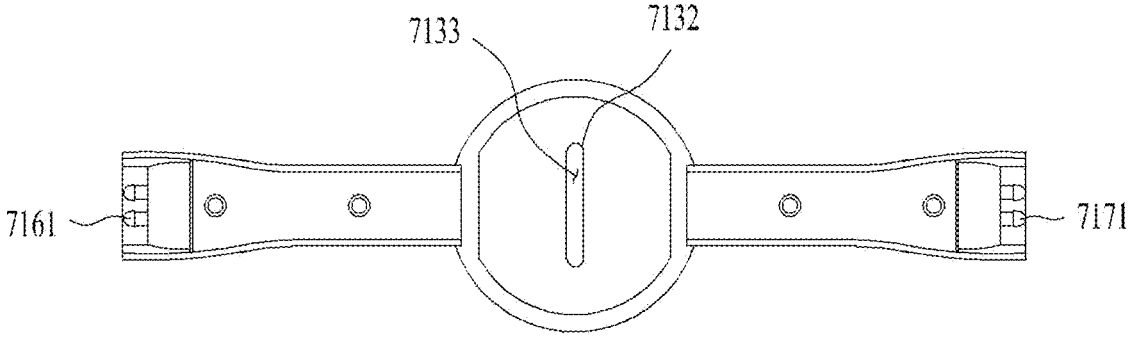
FIG. 7B is a top view of a hanger assembly.
Figure 7C:
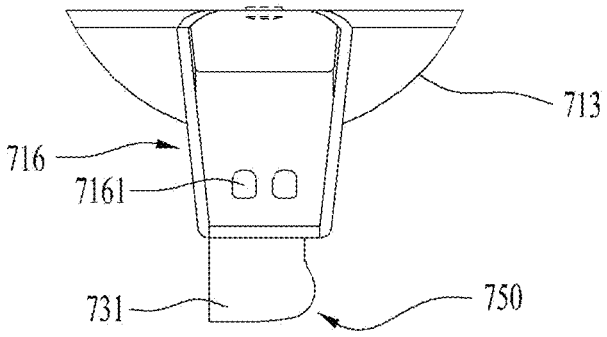
FIG. 7C is a left side view of a hanger assembly.

FIGS. 7A to 7C show an example in which the first hanging portion 751 and the third hanging portion 753 are disposed on the left and right side surfaces of the first extended body 731, respectively. Similarly, both of the left and right side surfaces of each of the plurality of second extended bodies 732 may also include the hooking portions (see FIG. 8).

That is, the hanger assembly 700 may include each of a plurality of fourth hanging portions (not shown) coupled to the other of the left and right side surfaces of the free end of each second extended body 732 corresponding to each of the plurality of second hanging portions 752. Each of the plurality of fourth hanging portions may include a fourth hanging body (not shown), a fourth hanging body top surface (not shown) of surfaces of the fourth hanging body facing the top surface 101 of the first chamber, and a fourth hanger groove (not shown) defined by extending through the fourth hanging body (not shown) including a portion of the fourth hanging body top surface (not shown) in the depth direction (the X/−X direction) of the first chamber.

This is because not only more laundry may be stored when using the first chamber 100 as a space to simply accommodate the laundry, but also the permeating of the steam and the hot air and the drying are easy even with the small spacing between the two clothes in a case of a thin clothes such as the dress shirt.

In addition, when the hanging portions are disposed on both side surfaces of each extended body, the user may use both hands thereof regardless of whether the user is left-handed or right-handed. In addition, the hanging distance between the two clothes may be freely defined based on a thickness of the clothes.

For example, FIG. 7A shows an example in which a total of six clothes may be hung because the first extended body has the two hanging portions. This is to accommodate more clothes by accommodating thin clothes on the first hanging portion 751 and the third hanging portion 753. Similarly, because each of all extended bodies may include the two hanging portions, that is, each of the plurality of second hanging portions and each of the plurality of fourth hanging portions, each of the left and right side surfaces of each of the second extended bodies may include the hanging portion such that a total of ten clothes may be hung. In one example, when the number of extended bodies increases, more clothes may be accommodated accordingly. This is called a dual hanger.

In one example, the first hanging portion 751 and the third hanging portion 753 may be located at the same vertical level with respect to the bottom surface 102 of the first chamber. This is for symmetrical aesthetics. In addition, a distance between the first hanging portion 751 and the third hanging portion 753 may be smaller than a distance between the first hanging portion 751 and the closest second hanging portion 752 of the plurality of second hanging portions 752 or a distance between the two adjacent second hanging portions 752 of the plurality of second hanging portions 752.

In addition, a maximum vertical dimension from the bottom surface 102 of the first chamber to the first hanging body top surface 7512 is smaller than a vertical dimension from the bottom surface 102 of the first chamber to a position at which the central body 713 and the first extended body 731 meet each other. Referring to FIG. 7A, this means that a vertical dimension from the bottom surface of the cabinet to L1 is smaller than a vertical dimension from the bottom surface of the cabinet to L2. Accordingly, unlike the conventional hanger assembly 800, the user may easily hang the laundry in the first hanger groove 7513 via the side surface of the extended body extended downwards, without having to difficultly hang the laundry beyond the central body 713.

In other words, the hanger bar and the hanger groove were formed integrally in the past, but in the hanger assembly 700 of the present disclosure, the hanging portions 751, 752, and 753, which correspond to the conventional hanger grooves, may be disposed spaced apart from the hanger body assembly 710, which corresponds to the conventional hanger bar. That is, the hanger body assembly 710 and the laundry hanging portion 750 may be formed independently of each other.

Therefore, the user may access each of the hanging portions 751, 752, and 753 via the side surface of each of the extended bodies after inserting the clothes hanger into a space between the corresponding extended body and another extended body adjacent thereto, so that interference with the hanger body assembly 710 may be prevented.

In this regard, the reason why the term 'maximum vertical dimension to the first hanging body top surface 7512' is used is that the first hanging body top surface 7512 may have a curved shape as shown in FIG. 6.

This means that the laundry may be easily hung from the side surface of the first hanging portion 751 to the first hanger groove 7513 without the view being obstructed. This is for a convenience of the user.

Similarly, a maximum vertical dimension from the bottom surface 102 of the first chamber to the top surface 7522 of one of the plurality of second hanging bodies 7521 may be smaller than a vertical dimension from the bottom surface 102 of the first chamber to a position at which the first body 711 or the second body 712 is coupled to the one second extended body 732 and meets the corresponding one second extended body 732. This means that the user may access each of the plurality of second hanger grooves 7523 via the side surface of each of the plurality of second extended bodies when hanging the laundry.

In this regard, the reason why the term 'maximum vertical dimension to the second hanging body top surface 7522' is used is that the second hanging body top surface 7522 may have a curved shape as shown in FIG. 6.

The reason why the first hanging body top surface 7512 and the second hanging body top surface 7522 are in the curved shape is that the hook of the clothes hanger has the curved shape. Therefore, when hanging the clothes hanger in the hanger grooves 7513, 7523, and 7533, the clothes hanger may be more conveniently hung than in a case of an angled top surface. This may also be applied to the third hanging portion 753.

Referring to FIG. 7A, a first length EL1 and a second length EL2 or EL3 may be different from each other. In addition, the lengths EL2 and EL3 of the plurality of second extended bodies may also be different from each other.

FIG. 7B is a top view of the hanger assembly 700. The slot 7132 may be defined inside the central body 713, and the power conversion means 680 may be inserted into the slot 7132 to convert the rotational motion of the motor into the reciprocating motion along the width direction of the first chamber 100. In this regard, the reciprocating motion along the width direction of the first chamber 100 may be a linear motion in the width direction of the first chamber 100, or may be an elliptical motion with a large eccentricity in the width direction of the first chamber 100. This may vary depending on the length of the slot and the length of the connecting rod. When half of a length S1 of the slot 7132 is greater than the length of the connecting rod 682, the hanger assembly 700 may move linearly in the width direction of the first chamber. On the other hand, when the half of the length S1 of the slot 7132 is greater than the length of the connecting rod 682, the hanger assembly 700 may perform the elliptical motion with a long axis in the width direction of the first chamber.

In any case, when the laundry treating apparatus is viewed from the front, the hanger assembly 700 may reciprocate mainly in the width direction of the first chamber.

FIG. 7C shows a state of the hanger assembly 700 when viewed from the left side surface 1091 of the first chamber. A distance from the top surface 101 of the first chamber to a lower end of the first connection body 716 may be smaller than a distance from the top surface 101 of the first chamber to a lower end of the first extended body 731.

This is because the central body 713 for accommodating the power conversion means 680 therein must be larger than the first body 711 and second body 712, and the vertical dimension from the bottom surface of the cabinet to L1 must be smaller than the vertical dimension from the bottom surface of the cabinet to L2 in order to easily hang the laundry via one side surface of the first extended body. Therefore, the distance from the top surface 101 of the first chamber to the lower end of the first connection body 716 may be smaller than the distance from the top surface 101 of the first chamber to the lower end of the first extended body 731.

Figure 8:
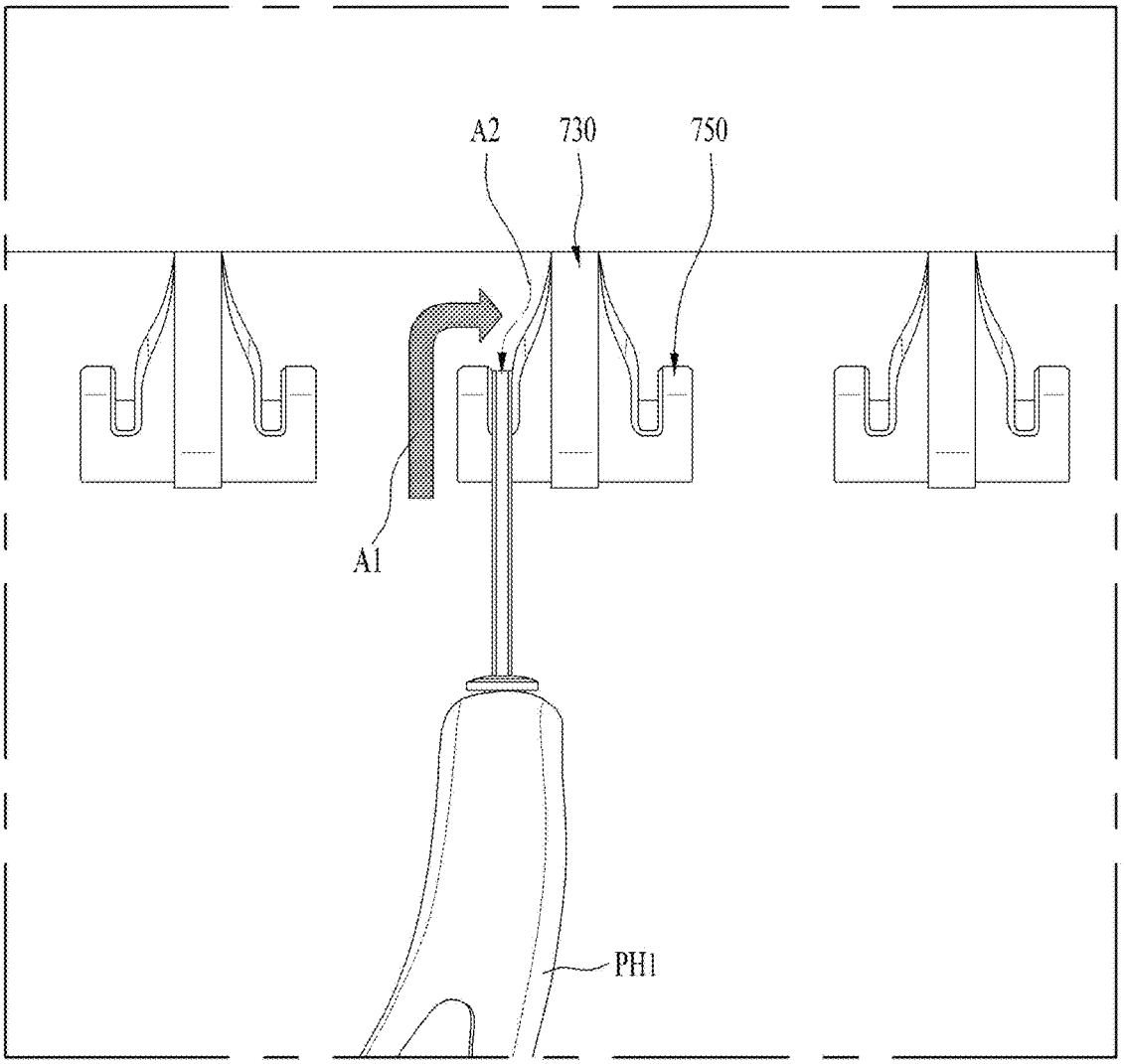
FIG. 8 shows an example in which laundry hanging portions are disposed on both sides of an extended body assembly.

FIG. 8 shows an example of a dual hanger in which the laundry hanging portions 750 are disposed on both side surfaces of the extended body assembly 730. When hanging the clothes hanger PH1 on the laundry hanging portion 750, the user may access the laundry hanging portion 750 in a direction indicated by an arrow A1, that is, via the side surface of the extended body assembly 730. Then, the user may hang the clothes hanger PH1 in the inner groove of the laundry hanging portion 750, that is, the hanger groove, in a direction indicated by an arrow A2. A portion of the laundry hanging portion 750 coupled to one side surface of the extended body may be inclined. Therefore, when moving the clothes hanger downwards, the user may naturally hang the clothes hanger in the groove inside the laundry hanging portion 750.

The present disclosure may be modified and implemented in various forms, so that the scope of rights is not limited to the above-described embodiment. Therefore, when the modified embodiment includes components of the claims of the present disclosure, it should be viewed that the modified embodiment belongs to the scope of the present disclosure.

What is claimed is:

1. A laundry treating apparatus comprising:

a cabinet having an inlet defined in one surface thereof;

a door pivotably coupled to the cabinet and configured to open and close the inlet;

a first chamber located inside the cabinet and configured to accommodate laundry therein via the inlet;

a first support that extends from a top surface of the first chamber;

a second support that extends from the top surface of the first chamber; and a hanger assembly located inside the first chamber for hanging the laundry thereon, wherein the hanger assembly includes:

a central body located in the first chamber, a first body and a second body that each extend from the central body along a width direction of the first chamber, a first connection body that extends from a free end of the first body toward a bottom surface of the first chamber and that is connected to the first support, the first connection body extending below a lower surface of the first body, a second connection body that extends from a free end of the second body toward the bottom surface of the first chamber and that is connected to the second support, the second connection body extending below a lower surface of the second body, an extended body assembly that extends toward the bottom surface of the first chamber and that is located between the first connection body and the second connection body, and a laundry hanging portion located at a side surface of the extended body assembly and configured to hang the laundry thereon, wherein the extended body assembly includes:

a first extended body extending from the central body toward the bottom surface of the first chamber by a predetermined first length, and a plurality of second extended bodies extending from the first body and the second body toward the bottom surface of the first chamber by a predetermined second length, wherein the predetermined first length is greater than the predetermined second length.

2. The laundry treating apparatus of claim 1, wherein the central body defines an opening that is opened in a direction toward the top surface of the first chamber, and wherein the laundry hanging portion includes:

a first hanging portion coupled to one of left and right side surfaces of the first extended body and configured to hang the laundry therein, and a plurality of second hanging portions that are each coupled to one of left and right side surfaces of each of the plurality of second extended bodies and that are configured to hang the laundry therein.

3. The laundry treating apparatus of claim 2, wherein the first hanging portion includes:

a first hanging body coupled to one of left and right side surfaces of a free end of the first extended body;

a first hanging body top surface facing the top surface of the first chamber among surfaces of the first hanging body; and a first hanger groove defined by extending through the first hanging body including a portion of the first hanging body top surface in a depth direction of the first chamber, and wherein each of the plurality of second hanging portions includes:

a second hanging body coupled to one of left and right side surfaces of a free end of each of the second extended bodies corresponding to each of the plurality of second hanging portions, a second hanging body top surface facing the top surface of the first chamber among surfaces of the second hanging body, and a second hanger groove defined by extending through the second hanging body including a portion of the second hanging body top surface in the depth direction of the first chamber.

4. The laundry treating apparatus of claim 3, wherein the laundry hanging portion further includes a third hanging portion that is coupled to the other of the left and right side surfaces of the first extended body and that is configured to hang the laundry therein, and wherein the third hanging portion includes:

a third hanging body coupled to the other of the left and right side surfaces of the free end of the first extended body;

a third hanging body top surface facing the top surface of the first chamber among surfaces of the third hanging body; and a third hanger groove defined by extending through the third hanging body in the depth direction of the first chamber such that a portion of the third hanging body top surface is opened.

5. The laundry treating apparatus of claim 4, wherein the first hanging portion and the third hanging portion are located at the same vertical level relative to the bottom surface of the first chamber.

6. The laundry treating apparatus of claim 4, wherein the first hanging body top surface, the second hanging body top surface, and the third hanging body top surface are curved surfaces.

7. The laundry treating apparatus of claim 3, wherein a maximum vertical dimension from the bottom surface of the first chamber to the first hanging body top surface is smaller than a vertical dimension from the bottom surface of the first chamber to a position where the central body and the first extended body meet each other, wherein a maximum vertical dimension from the bottom surface of the first chamber to a top surface of one of the plurality of second hanging bodies is smaller than a vertical dimension from the bottom surface of the first chamber to a position where the first body or the second body is coupled to the one second extended body and meets the corresponding one second extended body.

8. The laundry treating apparatus of claim 7, wherein a vertical level of the first hanging body is lower than a vertical level of the second hanging body based on the bottom surface of the first chamber.

9. The laundry treating apparatus of claim 8, wherein the first body and the second body are located closer to the opening than to a lower portion of the central body.

10. The laundry treating apparatus of claim 8, wherein the extended body assembly extends below the lower surface of the first body or the lower surface of the second body.

11. The laundry treating apparatus of claim 8, wherein the central body is hemispherical.

12. The laundry treating apparatus of claim 1, wherein the first support and the second support have (i) first ends that are connected to the top surface of the first chamber and (ii) second ends that are respectively connected to lower portions of the first connection body and the second connection body.

13. The laundry treating apparatus of claim 1, further comprising:

a top panel that defines a top surface of the cabinet; and a driver that is located between the top panel and the top surface of the first chamber and that is configured to generate rotational force to reciprocate the hanger assembly in the width direction of the first chamber.

14. The laundry treating apparatus of claim 13, wherein a lower portion of the first support is coupled to a lower portion of the first connection body, wherein a lower portion of the second support is coupled to a lower portion of the second connection body.

15. The laundry treating apparatus of claim 14, wherein the driver includes a power converter configured to reciprocate the hanger assembly by converting the rotational force of the driver, wherein the hanger assembly further includes a slot located inside the central body and defined in a depth direction of the first chamber, and wherein the power converter includes:

a rotating protrusion configured to be rotated by the rotational force of the driver;

a connecting rod that extends in an orthogonal direction from the rotating protrusion; and a connecting protrusion that protrudes from one end of the connecting rod and that is inserted into the slot to reciprocate the hanger assembly.

16. A laundry treating apparatus comprising:

a cabinet having an inlet defined in one surface thereof;

a first chamber located inside the cabinet and configured to accommodate laundry therein via the inlet;

a second chamber positioned below the first chamber, the second chamber defining a space separated from the first chamber;

a steam unit located inside the second chamber and configured to supply steam to the first chamber;

a blower located inside the second chamber and configured to circulate air in the first chamber;

a heat pump configured to exchange heat with air suctioned via the blower;

a first support that extends from a top surface of the first chamber;

a second support that extends from the top surface of the first chamber; and a hanger assembly located inside the first chamber for hanging the laundry thereon, wherein the hanger assembly includes:

a central body located in the first chamber, a first body and a second body that each extend from the central body along a width direction of the first chamber, a first connection body that extends from a free end of the first body toward a bottom surface of the first chamber and that is connected to the first support, the first connection body extending below a lower surface of the first body, a second connection body that extends from a free end of the second body toward the bottom surface of the first chamber to be connected to the second support, the second connection body extending below a lower surface of the second body, an extended body assembly that extends toward the bottom surface of the first chamber and that is located between the first connection body and the second connection body, and a laundry hanging portion located at a side surface of the extended body assembly and configured to hang the laundry thereon, wherein the extended body assembly includes:

a first extended body extending from the central body toward the bottom surface of the first chamber by a predetermined first length, and a plurality of second extended bodies extending from the first body and the second body toward the bottom surface of the first chamber by a predetermined second length, wherein the predetermined first length is greater than the predetermined second length.

17. The laundry treating apparatus of claim 16, wherein the extended body assembly extends below the lower surface of the first body or the lower surface of the second body.

18. The laundry treating apparatus of claim 16, wherein the hanger assembly is disposed below the first support and the second support, and wherein the first connection body and the second connection body extend downward away from the first support and the second support, respectively.

19. The laundry treating apparatus of claim 16, wherein the steam unit comprises:

a storage configured to receive water; and a heater located inside the storage and configured to heat the water in the storage.

20. The laundry treating apparatus of claim 19, wherein the steam unit further comprises a temperature sensor configured to measure a temperature of the water in the storage.

* * * * *